US007539443B2

(12) United States Patent
Kamoshida et al.

(10) Patent No.: US 7,539,443 B2
(45) Date of Patent: May 26, 2009

(54) CHARGING ROLLER AND IMAGE FORMING APPARATUS

(75) Inventors: Shinichi Kamoshida, Nagano-ken (JP); Atsunori Kitazawa, Nagano-ken (JP); Tadahiro Mizutani, Nagano-ken (JP); Katsumi Okamoto, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 239 days.

(21) Appl. No.: 11/449,473

(22) Filed: Jun. 8, 2006

(65) Prior Publication Data

US 2006/0280518 A1 Dec. 14, 2006

(30) Foreign Application Priority Data

| | | |
|---|---|---|
| Jun. 8, 2005 | (JP) | P2005-168084 |
| Jun. 8, 2005 | (JP) | P2005-168085 |
| Jun. 8, 2005 | (JP) | P2005-168086 |
| Jun. 8, 2005 | (JP) | P2005-168087 |
| Jun. 8, 2005 | (JP) | P2005-168088 |

(51) Int. Cl.
*G03G 15/02* (2006.01)

(52) U.S. Cl. ..... 399/176

(58) Field of Classification Search ..... 399/100, 399/115, 168, 176, 174, 265, 279, 286; 492/40, 492/48, 49; 361/221
See application file for complete search history.

(56) References Cited

U.S. PATENT DOCUMENTS

2004/0109706 A1 * 6/2004 Kosuge et al. ..... 399/168

FOREIGN PATENT DOCUMENTS

| | | |
|---|---|---|
| JP | 2004-109151 | 4/2004 |
| JP | 2005-017767 | 1/2005 |

* cited by examiner

*Primary Examiner*—David M Gray
*Assistant Examiner*—Andrew V Do
(74) *Attorney, Agent, or Firm*—Hogan & Hartson LLP

(57) ABSTRACT

A charging roller is provided. The charging roller is configured to face an image carrier at a predetermined charging gap and charge the image carrier in a non-contact state. A conductive shaft is provided with a pair of annular concave portions formed on an outer circumferential surface at both ends thereof. A conductive layer is formed on the outer circumference surface at a center portion of the conductive shaft defined between the pair of concave portions. An insulating layer is formed on the outer circumferential surface at outer portions of the conductive shaft from the pair of annular concave portions. A depth of the concave portions is larger than a thickness of the conductive layer.

9 Claims, 8 Drawing Sheets

CHARGING ROLLER AND IMAGE FORMING APPARATUS

BACKGROUND OF THE INVENTION

1. Technical Field of the Invention

The present invention relates to a charging roller which is used for an image forming apparatus such as an electrophotography, an electrostatic copier, a printer, and a facsimile and charges an image carrier at a predetermined charging gap in a non-contact manner.

The present invention relates to an image forming apparatus in which a charging roller charges an image carrier in a non-contact manner, such as an electrophotography, an electrostatic copier, a printer, and a facsimile, and more particularly, to an image forming apparatus in which a charging roller, an optical record device, and a development roller device are sequentially arranged in the vicinity of an image carrier toward a downstream side in a rotation direction of the image carrier and the charging roller is cleaned by a cleaning member which is closely in contact with the charging roller.

2. Description of the Related Art

In a conventional image forming apparatus, there is known a charging roller for charging an image carrier at a predetermined charging gap in a non-contact manner (for example, Japanese Unexamined Patent Application Publication No. 2004-109151; hereinafter referred to as JPA'151). In the charging device disclosed in JPA'151, ring shaped regulating members are fixed to recessed steps formed in the both ends such that fitting phases of the regulating members are not coincident with each other. According to the charging roller disclosed in JPA'151, it is possible to obtain a charging gap with required precision at low cost.

However, in the charging roller disclosed in JPA'151, in order to form the recessed annular steps in the both ends, a base shaft of the charging roller is first polished and a bottom of the recessed steps are polished. In this case, it is very difficult to make the depth of the polished steps uniform and allow a center axis of the base shaft and center axes of the bottoms of the annular steps to be coincident (concentric) with each other. Although mounting positions of the ring-shaped regulating members fixed to the steps are adjusted such that the fitting phases are not coincident with each other, it is difficult to manufacture the charging roller having a charging gap with high precision, stability, and reliability.

In addition, in another conventional image forming apparatus, there is known a charging roller for charging an image carrier at a predetermined charging gap in a non-contact manner (for example, Japanese Unexamined Patent Application Publication No. 2005-17767; hereinafter referred to as JPA'767). The charging roller disclosed in JPA'767 includes a conductive core (metal shaft) and a conductive resin layer formed on the conductive core. The conductive resin layer is obtained by mixing carbon black (CB) to thermoplastic resin as a conductive agent. The amount of the carbon black (CB) is 5 to 40 wt % with respect to 100 wt % of the thermoplastic resin.

However, when the carbon black (CB) is used as the conductive agent and the amount of the carbon black (CB) is large, a resistance value of the charging roller decreases and a chain structure in which the carbon black (CB) is linked in the entire conductive resin layer is formed. To this end, when a constant voltage is applied to the charging roller, charge leakage occurs between a specific position of the charging roller and a specific position of a photosensitive body and stable charging cannot be performed.

In contrast, when the amount of the carbon black (CB) is small, the resistance value of the charging roller too increases, a charging time constant is delayed. Thus, a discharge amount is reduced and charging cannot be uniformly performed.

In addition, as a conventional image forming apparatus such as an electrophotography, an electrostatic copier, a printer, and a facsimile, there is known an image forming apparatus in which a charging roller, an optical record device, and a development roller device are sequentially arranged in the vicinity of a rotating image carrier toward a downstream side in a rotation direction of the image carrier (for example, Japanese Unexamined Patent Application Publication No. 2004-66758; hereinafter referred to as JPA'758). In the image forming apparatus disclosed in JPA'758, a photosensitive body is uniformly charged by rotating a contact-type charging brush in the same direction as the photosensitive body while being in contact with the photosensitive body (circumferential velocity directions of the photosensitive body and the contact-type charging brush are opposite to each other), an electrostatic latent image is formed on the photosensitive body by an optical record device, and the electrostatic latent image on the photosensitive body is developed with toner carried by the development roller, thereby forming a toner image.

However, in the image forming apparatus disclosed in JPA'758, since the optical record device is positioned below a position in which the contact-type charging brush and the photosensitive body are in contact with each other (position of the photosensitive body charged by the contact-type charging brush), an extraneous material such as remaining toner after transferring the toner onto the photosensitive body is separated from the photosensitive body by the contact of the contact-type charging brush and floats in the apparatus or attached to the contact-type charging brush. The optical record device is contaminated. The optical record device may be used in practice, but a high-quality image cannot be obtained for a long time. In addition, since the circumferential velocity direction of the photosensitive body and the circumferential velocity direction of the contact-type charging brush are opposite to each other, the floating of the extraneous material may become more serious. Furthermore, since the extraneous material is attached to the contact-type charging brush, good charging is hard to be performed for a long time and durability of the contact-type charging brush may be sacrificed.

SUMMARY OF THE INVENTION

The present invention is to solve the above-described problems, and it is a first object of the present invention to provide a non-contact charging roller capable of easily obtaining a charging gap with high precision, stability, and reliability at the time of charging an image carrier in a non-contact manner.

In addition, it is a second object of the present invention to provide a non-contact charging roller capable of stably charging an image carrier without causing charge leakage at a specific position at the time of charging an image carrier in a non-contact manner.

Furthermore, it is a third object of the present invention to provide an image forming apparatus capable of improving durability of a charging roller while suppressing an optical record device from be contaminated by an extraneous material such as toner which floats or toner which is attached to the charging roller at the time of charging the image carrier by the charging roller.

In order to solve at least one of the above-described problems, a first embodiment of the present invention is characterized in that, in a charging roller in which a conductive layer is formed on a conductive shaft, faces an image carrier at a predetermined charging gap, and charges the image carrier in a non-contact state, annular concave portions are formed in the outer circumferential surfaces of the both ends of the conductive shaft, the conductive layer is formed by coating the outer circumferential surface of a center portion of the conductive shaft between the concave portions with a conductive coating material, and an insulating layer for setting the charging gap is formed by coating the outer circumferential surfaces of the both ends of the conductive shaft outer than the concave portions with an insulating coating material.

In the charging roller according to the first embodiment, the depth of the concave portions is set to be larger than the film thickness of the conductive layer.

In the charging roller according to the first embodiment, the depth of the concave portions is set to be larger than the film thickness of the insulating layer.

In the charging roller according to the first embodiment, the depth of the concave portions is set to be larger than a sum of the film thickness of the conductive layer and the film thickness of the insulating layer.

In the charging roller according to the first embodiment, edges of the concave portions of the conductive shaft are chamfered.

According to the charging roller of the first embodiment having the above-described configuration, since the insulating layer for setting the charging gap is formed on the outer circumferential surface of the conductive shaft, it is possible to simply set the charging gap with stability and high precision. In addition, since the concave portions of the conductive shaft are not directly related to the charging gap, the concave portions need not be manufactured with high precision and thus the charging roller can be manufactured at low cost.

In addition, the insides of the annular concave portions formed in the both ends of the conductive shaft are coated with the conductive coating material and the insulating coating material. In a state that the insulating layers are in contact with the image carrier, since portions of the concave portions coated with the conductive coating material are distant from the image carrier, the charging gap for non-contact charging is not formed and discharging onto the image carrier is not performed. Thus, the portions of the concave portions coated with the conductive coating material do not contribute to the non-contact charging. Accordingly, the concave portions can be used as coating boundaries of the conductive coating material and an insulating coating material and thus the conductive coating material and the insulating coating material can be easily formed with high precision.

In a case where the concave portions are not formed in the both ends of the conductive shaft, when the insulating layers are formed by coating the both ends with the insulating coating material as shown in FIG. 2C, the film thickness of inner ends of the insulating layers shows a tendency to thicken due to a surface tension at the time of drying the insulating coating material after coating. Accordingly, it is impossible to form the insulating layers configuring the gap part with a uniform film thickness, that is, to set the uniform charging gap. This is similar in the film thickness of the both ends of the conductive layer configuring the charging part. In contrast, according to the charging roller, since the concave portions are formed in the both ends of the conductive shaft, the conductive coating material and the insulating coating material enter into the concave portions. Accordingly, although the film thicknesses of the ends of the conductive layer and the insulating layers show a tendency to thicken due to the surface tension at the time of drying the conductive coating material and the insulating coating material after coating, this tendency is absorbed by the concave portions and thus the film thickness of the conductive layer configuring the charging part and the film thickness of the insulating layers configuring the gap part become uniform. Accordingly, it is possible to perform better charging.

Particularly, when the depth of the concave portions is set to the film thickness of the conductive layer, the film thickness of the insulating layer, or the sum of the film thickness of the conductive layer and the film thickness of the insulating layer, it is possible to prevent the conductive coating material or the insulating coating material from being protruded from the concave portions and to stably form the charging gap using the insulating layers with high precision. In this case, the depth of the concave portions is larger than the film thickness when the conductive coating material and the insulating coating material are formed. Accordingly, it is possible to more efficiently prevent the conductive coating material and the insulating coating material from being protruded from the concave portions. By setting the depth of the concave portions in consideration that the film thickness of the ends of the conductive layer and the insulating layers shows a tendency to thicken, it is possible to more surely form the charging gap with stability and high precision.

Since the edges of the concave portions of the conductive shaft are chamfered, in the edges, a gradient from the outer circumferential surface of the conductive shaft to the concave portions does not rapidly vary. Accordingly, the edges of the concave portions of the conductive shaft can be surely covered with the conductive coating material and the insulating coating material. Accordingly, it is possible to more surely prevent charge leakage from the edges of the concave portions of the conductive shaft and to reduce the film thickness of the conductive layer.

In order to solve at least one of the above-described problems, a second embodiment of the present invention is characterized in that, in a charging roller in which a conductive layer is formed on a conductive shaft, faces an image carrier at a predetermined charging gap, and charges the image carrier in a non-contact state, annular concave portions are formed in the outer circumferential surfaces of the both ends of the conductive shaft, the conductive layer is formed by coating the outer circumferential surface of a center portion of the conductive shaft between the concave portions with a conductive coating material, and an insulating layer for setting the charging gap is formed by coating the outer circumferential surfaces of the both ends of the conductive shaft outer than the concave portions with a elastic insulating member.

In the charging roller according to the second embodiment, the elastic insulating member is a rubber member.

In the charging roller according to the second embodiment, the insulating layer includes a thermal shrinkage tube.

In the charging roller according to the second embodiment, the depth of the concave portions is set to be larger than the film thickness of the conductive layer.

In the charging roller according to the second embodiment, the depth of the concave portions is set to be larger than the film thickness of the insulating layer.

In the charging roller according to the second embodiment, the depth of the concave portions is set to be larger than a sum of the film thickness of the conductive layer and the film thickness of the insulating layer.

In the charging roller according to the second embodiment, edges of the concave portions of the conductive shaft are chamfered.

According to the charging roller of the second embodiment having the above-described configuration, since the insulating layer for setting the charging gap is formed on the outer circumferential surface of the conductive shaft, it is possible to simply set the charging gap with stability and high precision. In addition, since the concave portions of the conductive shaft are not directly related to the charging gap, the concave portions need not be manufactured with high precision and thus the charging roller can be manufactured at low cost.

In addition, the insides of the annular concave portions formed in the both ends of the conductive shaft are coated with the conductive coating material and the elastic insulating member. In a state that the insulating layers are in contact with the image carrier, since portions of the concave portions coated with the conductive coating material are distant from the image carrier, the charging gap for non-contact charging is not formed and discharging onto the image carrier is not performed. Thus, the portions of the concave portions coated with the conductive coating material do not contribute to the non-contact charging. Accordingly, the concave portions can be used as a coating boundary of the conductive coating material and a fixing boundary of a elastic insulating member and thus coating of the conductive coating material and fixing of the elastic insulating member can be easily performed with high precision.

In a case where the concave portions are not formed in the both ends of the conductive shaft, when the insulating layers are formed by fixing the elastic insulating member to the both ends, for example, with an adhesive as shown in FIG. 2C, the film thickness of inner ends of the insulating layers shows a tendency to thicken due to a surface tension at the time of drying the adhesive, or, when the insulating layers are formed using a thermal shrinkage tube as the elastic insulating member, the film thickness of the inner ends of the insulating layer shows a tendency to thicken by shrinkage of the thermal shrinkage tube. Accordingly, it is impossible to form the insulating layer configuring the gap part with a uniform film thickness, that is, to set the uniform charging gap. In contrast, according to the charging roller of the present invention, since the concave portions are formed in the both ends of the conductive shaft, the conductive coating material and the elastic insulating member enter into the concave portions. Accordingly, although the film thicknesses of the ends of the conductive layer and the insulating layers show a tendency to thicken due to the surface tension after forming and drying the conductive coating material and after fixing the elastic insulating member, this tendency is absorbed by the concave portions and thus the film thickness of the conductive layer configuring the charging part and the film thickness of the insulating layers configuring the gap part become uniform. Accordingly, it is possible to perform better charging.

Particularly, when the depth of the concave portions is set to the film thickness of the conductive layer, the film thickness of the insulating layer, or the sum of the film thickness of the conductive layer and the film thickness of the insulating layer, it is possible to prevent the conductive coating material or the elastic insulating member from being protruded from the concave portions and to stably form the charging gap using the insulating layers with high precision. In this case, according to Claim 6 of the present invention, the depth of the concave portions is larger than the film thickness when the conductive coating material and the elastic insulating member are formed. Accordingly, it is possible to more efficiently prevent the conductive coating material and the elastic insulating member from being protruded from the concave portions. By setting the depth of the concave portions in consideration that the film thickness of the ends of the conductive layer and the insulating layers shows a tendency to thicken, it is possible to more surely form the charging gap with stability and high precision.

Since the edges of the concave portions of the conductive shaft are chamfered, in the edges, a gradient from the outer circumferential surface of the conductive shaft to the concave portions does not rapidly vary. Accordingly, the edges of the concave portions of the conductive shaft can be surely covered with the conductive coating material and the elastic insulating member. Accordingly, it is possible to more surely prevent charge leakage from the edges of the concave portions of the conductive shaft and to reduce the film thickness of the conductive layer.

In order to solve at least one of the above-described problems, a third embodiment of the present invention is characterized in that, in a charging roller in which a conductive layer is formed on a conductive shaft, faces an image carrier at a predetermined charging gap, and charges the image carrier in a non-contact state, annular concave portions are formed in the outer circumferential surfaces of the both ends of the conductive shaft, an insulating layer for setting the charging gap is formed by coating the outer circumferential surfaces of the both ends of the conductive shaft outer than the concave portions with an insulating member, and the conductive layer is formed by coating the outer circumferential surfaces of the concave portions of the conductive shaft and the outer circumferential surface of a center portion of the conductive shaft between the concave portions with a conductive coating material.

In the charging roller according to the third embodiment, the conductive layer is also formed on the outer circumferential surface of the insulating layer by the conductive coating material.

In the charging roller according to the third embodiment, the depth of the concave portions is set to be larger than the film thickness of the conductive layer.

In the charging roller according to the third embodiment, the depth of the concave portions is set to be larger than the film thickness of the insulating layer.

In the charging roller according to the third embodiment, the depth of the concave portions is set to be larger than a sum of the film thickness of the conductive layer and the film thickness of the insulating layer.

In the charging roller according to the third embodiment, edges of the concave portions of the conductive shaft are chamfered.

According to the charging roller of the third embodiment having the above-described configuration, since the insulating layer for setting the charging gap is formed on the outer circumferential surface of the conductive shaft, it is possible to simply set the charging gap with stability and high precision. In addition, since the concave portions of the conductive shaft are not directly related to the charging gap, the concave portions need not be manufactured with high precision and thus the charging roller can be manufactured at low cost.

In addition, the insides of the annular concave portions formed in the both ends of the conductive shaft are coated with the conductive coating material and the insulating member. In a state that the insulating layers are in contact with the image carrier, since portions of the concave portions coated with the conductive coating material are distant from the image carrier, the charging gap for non-contact charging is not formed, and discharging onto the image carrier is not performed. Accordingly, the portions of the concave portions coated with the conductive coating material do not contribute to the non-contact charging. Accordingly, the concave portions can be used as a coating boundary of the conductive coating material and a mounting boundary of the insulating member (coating boundary when the insulating member is the insulating coating material) and thus coating of the conductive coating material and mounting of the insulating coating material can be easily performed with high precision.

In a case where the concave portions are not formed in the both ends of the conductive shaft, when the insulating layers are formed by coating the both ends with the insulating coating material as shown in FIG. 4C, the film thickness of an inner end of the insulating layers shows a tendency to thicken due to a surface tension at the time of drying the insulating coating material after coating. In addition, when the insulating layers are formed by fixing the elastic insulating member to the both ends, for example, with an adhesive, the film thickness of the inner end of the insulating layers shows a tendency to thicken due to a surface tension at the time of drying the adhesive, or, when the insulating layers are formed using a thermal shrinkage tube as the elastic insulating member, the film thickness of the inner end of the insulating layer shows a tendency to thicken by shrinkage of the thermal shrinkage tube. Accordingly, it is impossible to form the insulating layer configuring the gap part with a uniform film thickness, that is, to set the uniform charging gap. Since the film thickness of the both ends of the conductive layer shows a tendency to thicken due to a surface tension at the time of drying the conductive coating material after coating, it is impossible to form the conductive layer with a uniform film thickness, that is, to set the uniform charging gap. In contrast, according to the charging roller of the third embodiment, since the concave portions are formed in the both ends of the conductive shaft, the insulating member enters into the concave portions. Accordingly, although the film thickness of the ends of the insulating layers shows a tendency to thicken after mounting the insulating member, this tendency is absorbed by the concave portions and thus the film thickness of the conductive layer configuring the charging part and the film thickness of the insulating layers configuring the gap part become uniform. Accordingly, it is possible to perform better charging.

Particularly, when the depth of the concave portions is set to the film thickness of the conductive layer, the film thickness of the insulating layer, or the sum of the film thickness of the conductive layer and the film thickness of the insulating layer, it is possible to prevent the conductive coating material or the insulating member from being protruded from the concave portions and to stably form the charging gap using the insulating layers with high precision. In this case, according to Claim 5 of the present invention, the depth of the concave portions is larger than the film thickness when the conductive coating material and the insulating member are formed. Accordingly, it is possible to more efficiently prevent the conductive coating material and the insulating member from being protruded from the concave portions. By setting the depth of the concave portions in consideration that the film thickness of the ends of the conductive layer and the insulating layers shows a tendency to thicken, it is possible to more surely form the charging gap with stability and high precision.

Since the edges of the concave portions of the conductive shaft are chamfered, in the edges, a gradient from the outer circumferential surface of the conductive shaft to the concave portions does not rapidly vary. Accordingly, the edges of the concave portions of the conductive shaft can be surely covered with the conductive coating material and the insulating member. Accordingly, it is possible to more surely prevent charge leakage from the edges of the concave portions of the conductive shaft and to reduce the film thickness of the conductive layer.

In order to solve at least one of the above-described problems, a fourth embodiment of the present invention is characterized in that, in a charging roller in which a conductive resin layer having a film thickness of 5 to 50 μm is formed on a metal shaft, faces an image carrier at a predetermined charging gap, and charges the image carrier in a non-contact state, the conductive resin layer includes binder resin in which particles of conductive tin oxide ($SnO_2$) is independently dispersed.

According to the charging roller of the fourth embodiment having the above-described configuration, the conductive resin layer has a multi-layer structure having two layers or more and the concentration of the conductive tin oxide ($SnO_2$) in the binder resin increases from an innermost layer to an outermost layer.

According to the charging roller of the fourth embodiment having the above-described configuration, a portion or all of the binder resins in adjacent conductive resin layers having the multi-layer structure are the same.

According to the charging roller of the fourth embodiment having the above-described configuration, the conductive resin is ion conductive resin.

According to the charging roller of the fourth embodiment having the above-described configuration, since the conductive $SnO_2$ is used as the conductive agent, the chain structure is not formed in the layer, unlike the carbon black (CB) which was conventionally used as the conductive agent. Accordingly, the charge leakage is not generated at a specific position and thus stable charging can be performed.

Particularly, since the conductive resin layer has the multi-layer structure having two layers or more and the concentration of the conductive $SnO_2$ added to the binder resin sequentially increases from the inner layer to the outer layer, the resistance of the outer layer is more reduced.

Accordingly, in the entire conductive resin layer, since the amount of electrons, which can move to an uppermost conductive resin layer for the discharge, increases, the layer is hard to be destroyed due to the discharge. To this end, it is possible to perform stable charging for a long duration.

Since the conductive resin layer has the multi-layer structure having two layers or more and at least a portion or all of the adjacent inner and outer layers is made of the same resin, the layers made of the same resin are attached to each other and adhesion between the adjacent layers can be improved. Accordingly, in the charging roller to which a high bias voltage having a high frequency is applied, stable discharge can be performed for a long duration. To this end, it is possible to surely perform stable charging.

Since the binder resin of the conductive resin layer is the ion conductive resin, that is, the binder resin has the conductivity, it is possible to suppress the amount (concentration) of the conductive $SnO_2$ to a predetermined amount. To this end, even in the charging roller in which the thin conductive resin layer having a thickness of 5 to 50 μm is only formed on the metal shaft, it is possible to perform stable charging for a long duration and to manufacture the charging roller at low cost.

In order to solve at least one of the above-described problems, a fifth embodiment of the present invention is characterized in that, in an image forming apparatus in which a charging device, an optical record device, and a development device including a development roller are disposed in the vicinity of an image carrier in that order toward a downstream side in a rotation direction of the image carrier, the charging roller charges the image carrier at a predetermined charging gap with a non-contact state, a rotation center of the charging roller is located below a horizontal line passing through a rotation center of the image carrier, is located at a downstream side in the rotation direction of the image carrier than the horizontal line, and is located at an upstream side of the rotation direction of the image carrier just below the rotation direction of the image carrier, a cleaning member which is closely in contact with the charging roller and cleans the charging roller is rotatably provided, and a rotation center of the cleaning member is located below a horizontal line passing through the rotation center of the charging roller.

According to the charging roller of the fifth embodiment having the above-described configuration, the rotation direction of the charging roller is set to be opposite to the rotation direction of the image carrier and the rotation direction of the cleaning member is set to be opposite to the rotation direction of the charging roller.

According to the charging roller of the fifth embodiment having the above-described configuration, the circumferential velocity of the charging roller and the circumferential velocity of the image carrier are set to be equal to or substantially equal to each other (circumferential ratio is 1 or about 1).

According to the charging roller of the fifth embodiment having the above-described configuration, a straight line for connecting the rotation center of the charging roller and the rotation center of the image carrier and a straight line for connecting the rotation center of the charging roller and the rotation center of the cleaning member intersects each other.

According to the image forming apparatus of the fifth embodiment of the present invention having the above-described configuration, since the cleaning member is located below the horizontal line passing through the rotation center of the charging roller, that is, the cleaning member is located below the charging roller in the gravity direction, it is possible to naturally drop scraped extraneous material when the cleaning member scrapes the extraneous material on the charging roller such as the toner. To this end, the extraneous material such as the scraped toner does not advance to the optical record device. Accordingly, the extraneous material is hard to be attached to the optical record device and thus an image can be stably formed for a long direction. Particularly, since the charging roller charges the image carrier in the non-contact manner such that the extraneous material such as the toner is suppressed from floating from the image carrier upon the non-contact charging, it is possible to efficiently suppress the contamination of the optical record device.

Particularly, since the image carrier and the charging roller rotate in opposite directions, the cleaning member and the charging roller rotate in opposite directions, and the optical record device is disposed at the downstream side in the rotation direction of the image carrier than the charging roller, the extraneous material such as the toner scraped from the charging roller by the cleaning member can advance to the opposite side of the optical record device. Since the cleaning member functions as a wall, the extraneous material such as the scraped toner can be suppressed from advancing to the optical record device. To this end, the extraneous material is hard to be attached to the optical record device and thus the image can be stably formed for a long duration.

Since the circumferential velocity of the charging roller and the circumferential velocity of the image carrier are set to be equal or substantially equal to each other (circumferential velocity ratio is 1 or about 1), the extraneous material such as the toner is hard to float and thus the extraneous material can be efficiently suppressed from being attached to the optical record device. In addition, since the circumferential velocity of the cleaning member and the circumferential velocity of the charging roller are set to be equal or substantially equal to each other (circumferential velocity ratio is 1 or about 1), the extraneous material such as the toner is hard to float and thus the extraneous material can be efficiently suppressed from being attached to the optical record device.

Since the straight line for connecting the rotation center of the charging roller and the rotation center of the photosensitive body and the straight line for connecting the rotation center of the charging roller and the rotation center of the cleaning member intersect each other, the distance between the charging roller and the image carrier can be suppressed from being influenced by a contact force of the cleaning member against the charging roller. Accordingly, although the cleaning member is closely in contact with the charging roller, the charging gap can be stably set over the entire charging area for a long duration.

DETAILED DESCRIPTION OF THE INVENTION

Figure 1:
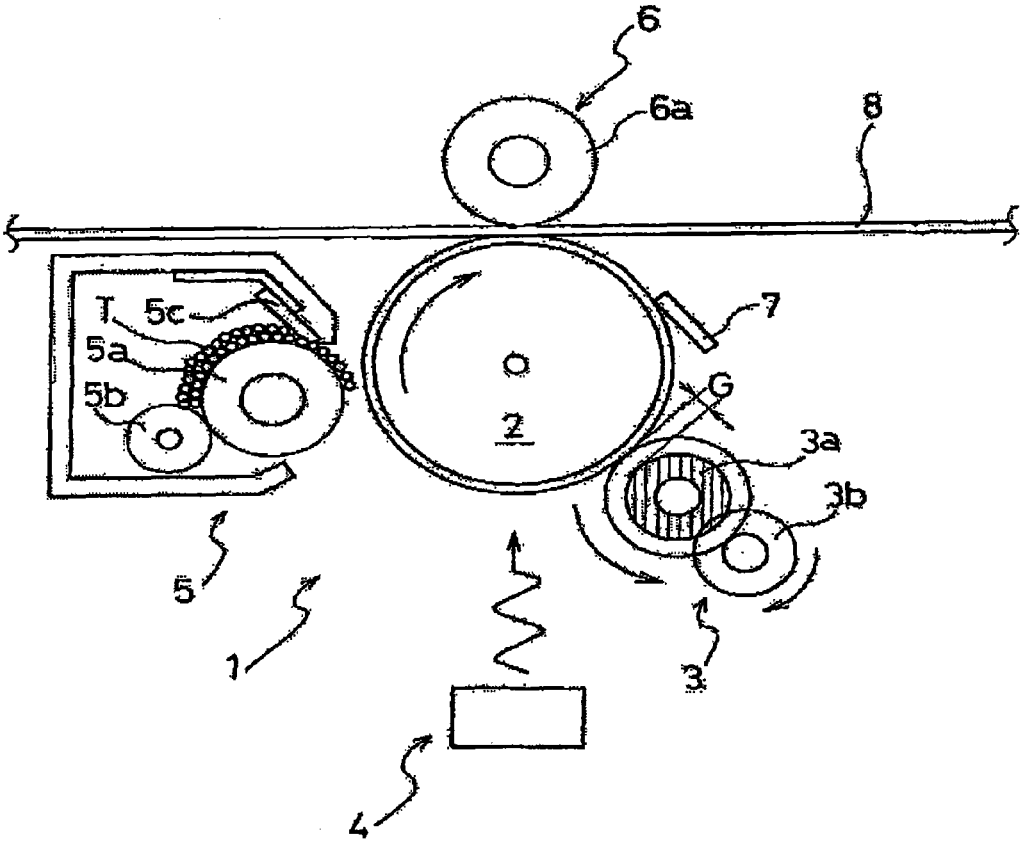
FIG. 1 is a partial view showing an example of an image forming apparatus including an example of a non-contact charging roller related to the present invention.

FIG. 1 is a partial view showing an example of an image forming apparatus used for non-contact charging rollers according to first to fourth embodiments of the present invention. Hereinafter, a charging roller according to a first embodiment and an image forming apparatus used for charging rollers according to first to fourth embodiment of the present invention will be described with reference to the attached drawings.

As shown in FIG. 1, an image forming apparatus 1 includes a photosensitive body 2 which is an image carrier on which an electrostatic latent image and a toner image are formed. The image forming apparatus 1 further includes a charging device 3, an optical record device 4, and a development device 5, a transfer device 6, and a cleaning device 7 in the vicinity of the photosensitive body 2 in that order from an upstream side in a rotation direction (clockwise direction in FIG. 1) of the photosensitive body 2.

The charging device 3 includes a non-contact charging roller 3*a* according to the present embodiment and a cleaning member 3*b* composed of, for example, a roller. The photosensitive body 2 is uniformly charged by the charging roller 3*a*, and the charging roller 3*a* is cleaned by the cleaning member 3*b* such that an extraneous material attached to the charging roller 3*a*, such as toner or dust, is removed.

Figure 2A:
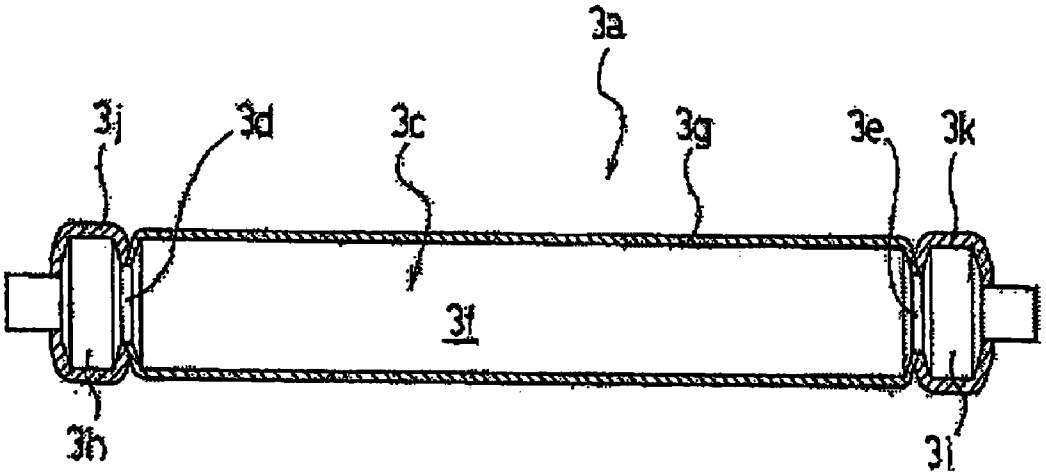
FIG. 2A is a side view taken along an axial direction of a charging roller according to a first embodiment of the present invention.

As shown in FIG. 2A, the non-contact charging roller 3*a* includes a core 3*c*. The core 3*c* is, for example, composed of a conductive shaft such as a metal shaft. For example, a conductive shaft obtained by coating the surface of SUM22 with Ni may be used.

Annular concave portions 3*d* and 3*e* are formed in the outer circumferential surfaces of the both ends of the core 3*c*. A conductive layer 3*g* is formed by coating the outer circumferential surface of a center portion 3*f* of the core 3*c* between the concave portions 3*d* and 3*e* with a conductive coating material using a spray coating method. In this case, the conductive coating material enters into the concave portions 3*d* and 3*e* to partially cover the concave portions 3*d* and 3*e* of the core 3*c*. The conductive layer 3*g* configures a charging part for charging the photosensitive body 2 at a predetermined charging gap G in a non-contact manner.

In addition, insulating layers 3*j* and 3*k* are formed by coating the outer circumferential surfaces of the both ends 3*h* and 3*i* of the core 3*c* outer than the concave portions 3*d* and 3*e* with an insulating coating material, for example, using a spray coating method. In this case, the insulating coating material enters into the concave portions 3*d* and 3*e* to partially cover the concave portions 3*d* and 3*e* of the core 3*c* and to cover the both ends of the core 3*c*. The outer diameters of the insulating layers 3*j* and 3*k* are set to be equal to each other. The film thickness of the insulating layers 3*j* and 3*k* is set to be larger than that of the conductive layer 3*g*. Accordingly, the insulating layers 3*j* and 3*k* are in contact with the photosensitive body 2 to configure a gap part for setting the predetermined charging gap G between the conductive layer 3*g* and the photosensitive body 2 based on a film thickness difference therebetween. The insulating layers 3*j* and 3*k* configuring the gap part are formed on the outer circumferential surface of the core 3*c*.

Figure 2B:
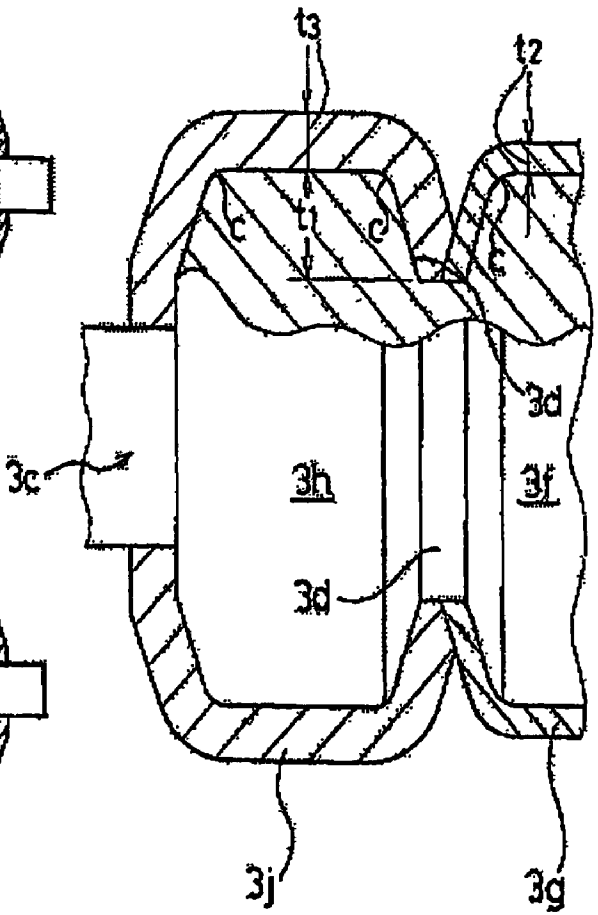
FIG. 2B is a partial enlarged cross-sectional view of FIG. 2A.

As shown in FIG. 2B, the depth $t_1$ of the concave portion 3*d* is set to be larger than a sum of the thickness $t_2$ of the conductive layer 3*g* and the film thickness $t_3$ of the insulating layer 3*j* ($t_1>t_2+t_3$). Accordingly, the depth $t_1$ of the concave portion 3*d* is set to be larger than any one of the film thickness $t_2$ of the conductive layer 3*g* and the film thickness $t_3$ of the insulating layer 3*j* ($t_1>t_2$, $t_1>t_3$, and $t_3>t_2$).

In addition, an edge of the concave portion 3*d* of the core 3*c* is chamfered (C-cut) c. Edges of the end 3*h* of the core 3*c* are also chamfered (C-cut) c. The chamfer c is generally called an R part and defined as a rounded edge obtained by cutting the edge in a curved shape. The chamfer c may be formed by cutting the edge in a flat slope surface.

Although FIG. 2B shows only the concave portion 3*d* and the insulating layer 3*j* of one end 3*h*, the concave portion 3*e* and the insulating layer 3*k* of the other end 3*i* are formed similar to the concave portion 3*d* and the insulating layer 3*j* of the end 3*h*.

The conductive layer 3*g* and the insulating layer 3*j* and 3*k* may be formed on the core 3*c* by forming the conductive layer 3*g* and then forming the insulating layers 3*j* and 3*k*, and vice versa.

The optical record device 4 records the electrostatic latent image on the photosensitive body 2, for example, using laser light. The development device 5 includes a development roller 5*a*, a toner feed roller 5*b*, and a toner layer thickness regulating member 5*c*. The toner T which is a development agent is fed onto the development roller 5*a* by the toner feed roller 5*b* and the thickness of the toner T on the development roller 5*a* is regulated by the toner layer thickness regulating member 5*c*. Then, the toner T is carried to the photosensitive body 2 and the electrostatic latent image on the photosensitive body 2 is developed by the carried toner T such that a toner image is formed on the photosensitive body 2.

The transfer device 6 has a transfer roller 6*a*, which transfers the toner image on the photosensitive body 2 onto a transfer medium 8 such as a transfer sheet or an intermediate transfer medium. When the toner image is transferred onto the transfer sheet which is the transfer medium 8, the toner image on the transfer sheet is fixed by a fixing device (not shown), thereby forming and an image on the transfer sheet. When the toner image is transferred onto the intermediate transfer medium which is the transfer medium 8, the toner image on the intermediate transfer medium is transferred onto a transfer sheet again and the toner image on the transfer sheet is fixed by a fixing device (not shown), thereby forming an image on the transfer sheet.

The cleaning device 7, for example, includes a cleaning member 7*a* such as a cleaning blade. The photosensitive body 2 is cleaned by the cleaning member 7*a* and remaining toner on the photosensitive body 2 is removed and collected.

According to the non-contact charging roller 3*a* having the above-described configuration, since the insulating members 3*j* and 3*k* configuring the gap part are formed on the outer circumferential surface of the core 3*c*, it is possible to simply set the charging gap G with stability and high precision. In addition, since the concave portions 3*d* and 3*e* of the core 3*c* are not directly related to the charging gap G, the concave portions need not be manufactured with high precision and thus the charging roller 3*a* can be manufactured at low cost.

In addition, the insides of the annular concave portions 3*d* and 3*e* formed in the both ends 3*h* and 3*i* of the core 3*c* are coated with the conductive coating material and the insulating coating material. In a state that the insulating layers 3*j* and 3*k* are in contact with the photosensitive body 2, since portions of the concave portions 3*d* and 3*e* coated with the conductive coating material are distant from the photosensitive body 2, the charging gap G for non-contact charging is not formed and discharging onto the photosensitive body 2 is not performed. Accordingly, the portions of the concave portions 3*d* and 3*e* coated with the conductive coating material do not contribute to the non-contact charging. Accordingly, the concave portions 3*d* and 3*e* can be used as coating boundaries of the conductive coating material and the insulating coating material and thus the conductive coating material and the insulating coating material can be easily formed with high precision.

Figure 2C:
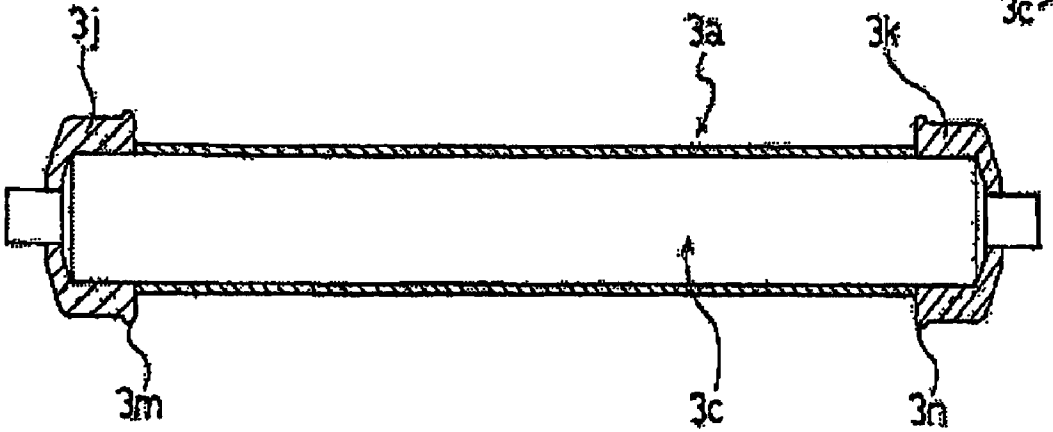
FIG. 2C is a side view taken along an axial direction of the charging roller of a comparative example.

In a case where the concave portions 3*d* and 3*e* are not formed in the both ends 3*h* and 3*i* of the core 3*c*, when the insulating layers 3*j* and 3*k* are formed by coating the both ends 3*h* and 3*i* with the insulating coating material as shown in FIG. 2C, the film thickness of inner ends 3*m* and 3*n* of the insulating layers 3*j* and 3*k* shows a tendency to thicken due to a surface tension at the time of drying the insulating coating material after coating. Accordingly, it is impossible to form the insulating layers 3*j* and 3*k* configuring the gap part with a uniform film thickness, that is, to set the uniform charging gap G. This is similar in the film thickness of the both ends of the conductive layer 3*g* configuring the charging part. In contrast, according to the charging roller 3*a* of this example, since the concave portions 3*d* and 3*e* are formed in the both ends 3*h* and 3*i* of the core 3*c*, the conductive coating material and the insulating coating material enter into the concave portions 3*d* and 3*e*. Accordingly, although the film thicknesses of the ends of the conductive layer 3*g* and the insulating layers 3*j* and 3*k* show a tendency to thicken due to the surface tension at the time of drying the conductive coating material and the insulating coating material after coating, this tendency is absorbed by the concave portions 3*d* and 3*e* and thus the film thickness of the conductive layer 3*g* configuring the charging part and the film thickness of the insulating layers 3*j* and 3*k* configuring the gap part become uniform. Accordingly, it is possible to perform better charging.

Since the edges of the concave portions 3*d* and 3*e* of the core 3*c* are chamfered c, in the edges, a gradient from the outer circumferential surface of the core 3*c* to the concave portions 3*d* and 3*e* does not rapidly vary. Accordingly, the edges of the concave portions 3*d* and 3*e* of the core 3*c* can be surely covered with the conductive coating material and the insulating coating material. Accordingly, it is possible to more surely prevent charge leakage from the edges of the concave portions 3*d* and 3*e* of the core 3*c* and to reduce the film thickness of the conductive layer 3*g*.

Since the depth $t_1$ of the concave portions 3*d* and 3*e* is set to be larger than the sum of the film thickness $t_2$ of the conductive layer 3*g* and the film thickness $t_3$ of the insulating layers 3*j* and 3*k*, the depth of the concave portions 3*d* and 3*e* is larger than the film thickness when the conductive coating material and the insulating coating material are formed. Accordingly, it is possible to prevent the conductive coating material and the insulating coating material from being protruded from the concave portions 3*d* and 3*e* and to stably form the charging gap G by the insulating layers 3*j* and 3*k* with high precision. By setting the depth of the concave portions 3*d* and 3*e* in consideration that the film thickness of the ends of the conductive layer 3*g* and the insulating layers 3*j* and 3*k* shows a tendency to thicken, it is possible to more surely form the charging gap G with stability and high precision.

Figure 3B:
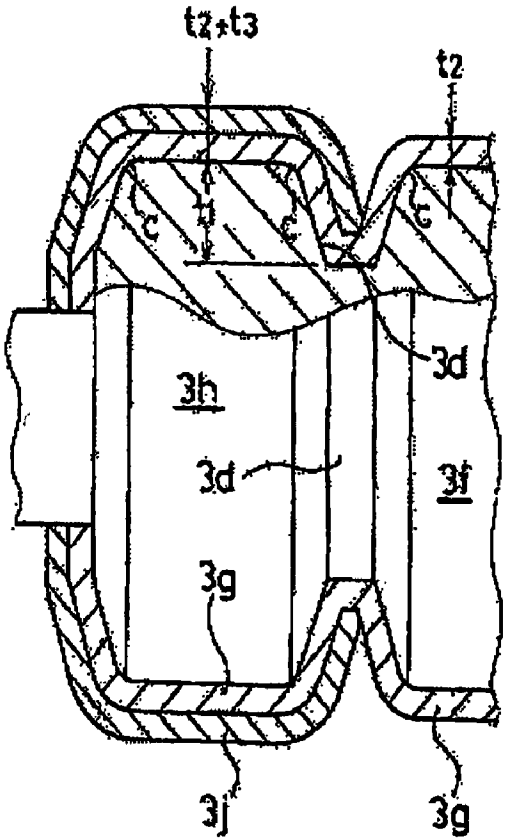
FIG. 3B is a partial enlarged cross-sectional view of FIG. 3A.
Figure 3A:
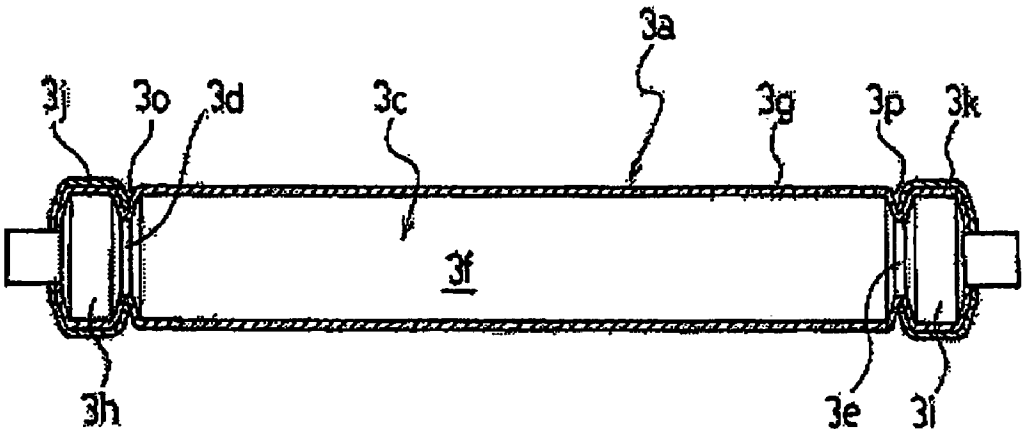
FIG. 3A is a cross-sectional view taken along an axial direction of another example of the charging roller according to the first embodiment of the present invention.
Figure 3C:
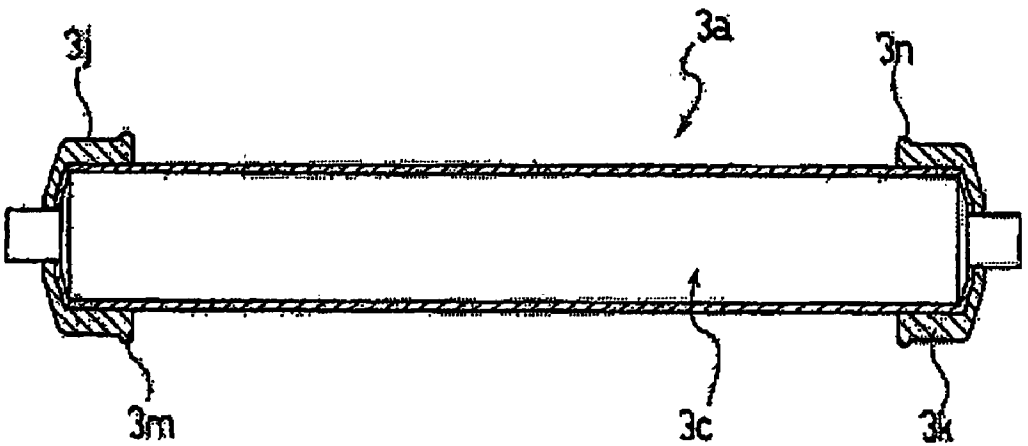
FIG. 3C is a cross-sectional view taken along the axial direction another comparative example of the charging roller according to the first embodiment of the present invention.

FIGS. 3A to 3C show another example and a comparative example of the charging roller according to the first embodiment of the present invention, where FIG. 3A is a cross-sectional view taken along an axial direction, FIG. 3B is a partial enlarged cross-sectional view of FIG. 3A, and FIG. 3C is a cross-sectional view taken along the axial direction of the comparative example. The same elements as those shown in FIGS. 2A to 2C are denoted by the same reference numerals and their detailed description will be omitted.

In the charging roller 3*a* of the example shown in FIGS. 2A and 2B, the conductive layer 3*g* is formed on the outer circumferential surface of the center portion 3*f* of the core 3*c* between the concave portions 3*d* and 3*e* and the insulating layers 3*i* and 3*k* are formed on the outer circumferential surfaces of the both ends 3*h* and 3*i* of the core 3*c* outer than the concave portions 3*d* and 3*e*, whereas, in the charging roller 3*a* of the example shown in FIGS. 3A and 3B, the conductive layer 3*g* is formed on all the outer circumferential surface of the center portion 3*f* of the core 3*c*, the outer circumferential surfaces of the concave portions 3*d* and 3*e* of the core 3*c*, and the outer circumferential surfaces of the both ends 3*h* and 3*i* of the core 3*c*, and the insulating layer 3*j* and 3*k* are formed on (the outer circumferential surface of) the conductive layers 3*g* formed on the outer circumferential surfaces of the both ends 3*h* and 3*i* of the core 3*c*. In this case, concave portions 3*o* and 3*p* are formed on the conductive layer 3*g* formed on the outer circumferential surface of the concave portions 3*d* and 3*e* of the core 3*c* in correspondence with the concave portions 3*d* and 3*e* and the insulating coating material partially enters into the concave portions 3*o* and 3*p*.

In the charging roller 3*a* of this example, the outer circumferential surface of the core 3*c* is sequentially coated with the conductive coating material and the insulating coating material. Even in the charging roller 3*a*, as shown in FIG. 3C, when the concave portions 3*d* and 3*e* are not formed in the both ends of the core 3*c*, the film thickness of inner ends 3*m* and 3*n* of the insulating layers 3*j* and 3*k* shows a tendency to thicken due to the surface tension at the time of drying the insulating coating material after coating. Accordingly, the film thickness of the insulating layers 3*j* and 3*k* configuring the gap part cannot become uniform.

The other configuration and effect of the charging roller 3*a* of this example is similar to those shown in FIGS. 2A and 2B.

Next, experimental examples and comparative examples of the non-contact charging roller according to the first embodiment of the present invention will be described. The charging rollers of the experimental examples which belong to the first embodiment of the present invention and the charging rollers of the comparative examples which do not belong to the first embodiment of the present invention are manufactured and an experiment for verifying that the charging roller according to the first embodiment can obtain the above-described effect is performed using the charging rollers 3*a*.

The charging rollers of the experimental examples and the comparative examples used in the experiment and the experimental result are shown in Table 1.

TABLE 1

| No. | Manufacturing method | Film thickness of conductive layer | Thickness of gap | Concave portion | Result | Note |
|---|---|---|---|---|---|---|
| 1 | Manufacturing method ① | 15 | 20 | Formed, C cut | ○ | |
| 2 | Manufacturing method ① | 30 | 20 | Formed, C cut | ○ | |
| 3 | Manufacturing method ① | 45 | 20 | Formed, C cut | ○ | |

TABLE 1-continued

| No. | Manufacturing method | Film thickness of conductive layer | Thickness of gap | Concave portion | Result | Note |
|---|---|---|---|---|---|---|
| 4 | Manufacturing method ② | 15 | 20 | Formed, C cut | ○ | |
| 5 | Manufacturing method ② | 30 | 20 | Formed, C cut | ○ | |
| 6 | Manufacturing method ② | 45 | 20 | Formed, C cut | ○ | |
| 7 | Manufacturing method ③ | 15 | 20 | Formed, C out | ○ | |
| 8 | Manufacturing method ③ | 30 | 20 | Formed, C cut | ○ | |
| 9 | Manufacturing method ③ | 45 | 20 | Formed, C cut | ○ | |
| 10 | Manufacturing method ① | 5 | 20 | Formed, straight | X | If the conductive layer is too thin, X |
| 11 | Manufacturing method ① | 10 | 20 | Formed, straight | ○ | |
| 12 | Mariufacturing method ① | 30 | 20 | Formed, straight | ○ | |
| 13 | Manufacturing method ① | 40 | 20 | Formed, straight | ○ | |
| 14 | Manufacturing method ② | 10 | 20 | Formed, straight | ○ | |
| 15 | Manufacturing method ③ | 10 | 20 | Formed, straight | ○ | |
| 16 | Manufacturing method ① | 40 | 20 | None | X | periodic image spots of the charging roller |
| 17 | Manufacturing method ② | 30 | 20 | None | X | periodic image spots of the charging roller |
| 18 | Manufacturing method ③ | 10 | 20 | None | X | periodic image spots of the charging roller |

Note of Table 1 is as follows:
Manufacturing method ①: the conductive layer is formed after forming the gap (forming the insulating film)
Manufacturing method ②: the gap is formed after forming the conductive layer (here, a shaft surface is disposed under the insulating film coating part)
Manufacturing method ③: the gap is formed after forming the conductive layer (here, the conductive layer coating film is disposed under the insulating film coating part)

In Table 1, Nos. 1 to 15 denote the charging rollers of the experimental examples of the first embodiment in which the concave portions 3*d* and 3*e* are formed in the both ends of the core 3*c*, as shown in FIGS. 2A and 2B and FIGS. 3A and 3B, and Nos. 16 to 18 denote the charging rollers of the comparative examples in which the concave portions 3*d* and 3*c* are not formed in the both ends of the core 3*c*, as shown in FIG. 2C and FIG. 3C. In Nos. 1 to 9 of the experimental examples, the edges of the concave portions 3*d* and 3*e* are C-cut, and, in the rest of Nos. 10 to 15, the edges of the concave portions 3*d* and 3*e* are not C-cut and are straight.

The shaft diameter of the core of each charging roller (diameter of a portion of the core 3*c* on which the conductive layers 3*g* is formed) of each example was ϕ8 mm. The core 3*c* obtained by coating the surface of SUM22 with Ni was used. The depth of concave portion formed in the core was set to 100 μm in the charging rollers of Nos. 1, 4, 7, 10, 11, 14, and 15, 125 μm in the charging rollers of Nos. 2, 5, 8, and 12, 150 μm in the charging rollers of Nos. 3, 6, 9, and 13.

The conductive coating material and the insulating coating material shown in Table 2 were used.

TABLE 2

| | |
|---|---|
| Conductive material (charging part) | Conductive $SnO_2$ 19%<br>PU 18%<br>Ion conductive material ⌈YYP-12⌋ 3%<br>Water 60% |
| Insulating material (gap part) | PU 100% |

As shown in Table 2, the conductive coating material is coating liquid including 19 wt % of conductive $SnO_2$, 18 wt % of polyurethane (PU), 3 wt % of an ion conductive material, and 60 wt % of water. The conductive $SnO_2$ is made by Jemco Inc. shown in Table 3 and the detailed contents are disclosed in a homepage of Jemco Inc.

TABLE 3

| Name | Physicality | Use |
|---|---|---|
| Tin-antimony oxide Sn—Sb Oxides Trademark T-1 | 1) aspect: grayish blue powder 2) specific resistance of powder: 1-3 Ω · cm (100 kg/cm$^2$ upon applying pressure) 3) particle shape: spherical 4) primary particle diameter: 0.02 μm 5) specific gravity: 6.6 | Antistatic agent Since a particle diameter is smaller than the wavelength of visible light, a transparent conductive film can be formed in a thin film shape. |
| Aqueous dispersion of tin-antimony oxide Sn—Sb Oxides Dispersed Trademark TDL | 1) aspect: blue liquid (water system) 2) solid concentration: 17 wt % 3) solid average particle diameter: 100 nm 4) specific gravity: 1.17 | Antistatic agent This is aqueous dispersion of antimony oxide doped tin oxide A transparent conductive film can be formed. |
| Tin-antimony oxide coating material/dispersion Liquid Paint Sn—Sb Oxides Paint Trademark ES | 1) aspect: blue liquid 2) coating film surface resistance (measuring method of this corporation) $10^{5-9}$ Ω/□ | 1) antistatic agent 2) near infrared ray cut material Since the particle diameter of a coating material is smaller than the wavelength of visible light, a high transparent conductive film and a near infrared ray cut material can be formed. |
| Titanium oxide/tin-antimony oxide $TiO_2$/Sn—Sb Oxides Trademark W-1 | 1) aspect: light gray powder 2) specific resistance of powder: 3-10 Ω · cm (100 kg/cm$^2$ upon applying pressure) 3) particle shape: spherical 4) primary particle diameter: 0.2 μm 5) specific gravity: 4.6 | Antistatic agent In kneading with resin, this is white or colorable conductive material. |

The conductive $SnO_2$ used in the experimental examples and the comparative examples is trademark "T-1" made by Jemco, Inc. "T-1" is tin-antimony oxide. In the first embodiment, the other conductive $SnO_2$ may be used.

The ion conductive material is to apply conductivity to the conductive coating material. The ion conductive material used in the experimental examples and the comparative examples is "YYP-12" (made by Marubishi Oil Chemical Co., Ltd.).

The insulating coating material configuring the gap part is 100 wt % of polyurethane (PU) resin.

In the method of manufacturing the charging rollers of the respective examples, the charging rollers of Nos. 1 to 3, 10 to 13, and 16 were manufactured using the manufacturing method (1) of coating the both ends of the core with the insulating coating material using the spray coating method to form the insulating layer and coating the center portion of the core with the conductive coating material using the spray coating method to form the conductive layer. The charging rollers of Nos. 4 to 6, 14 and 17 were manufactured using the manufacturing method (2) of coating the center portion of the core with the conductive coating material using the spray coating method to form the conductive layer and coating the both ends of the core with the insulating coating material using the spray coating method to form the insulating layer. In the manufacturing method (2), the conductive layer does not exist between the insulating layer and the core. The charging rollers of Nos. 7 to 9, 15, and 18 were manufactured using a manufacturing method (3) of coating the center portion, the concave portion, and the both ends of the core with the conductive coating material using the spray coating method to form the conductive layer, and coating the conductive layers of the both ends of the core with the insulating coating material using the spray coating method to form the insulating layer. In the manufacturing method (3), the conductive layer exists between the insulating layer and the core. The manufacturing methods ① to ③ in Table 1 correspond to the above-described manufacturing methods (1) to (3), respectively.

The photosensitive body was made of the same material as LP-9000C made by Seiko Epson Corporation. The film thickness of the photosensitive body was set to 23 μm, the diameter of the photosensitive body was set to ϕ24 mm, and the circumferential velocity of the photosensitive body was set to 250 mm/sec.

An experimental apparatus of the image forming apparatus had the same configuration as that of the LP-9000C. A voltage Vc (V) applied to the charging roller 3*a* was set to $$V_C = V_{DC} + V_{AC} = -650 + (1/2)V_{PP} \cdot \sin 2\pi ft$$

obtained by overlapping an AC component $V_{AC}$ (V) with a DC component $V_{DC}$ (V) (where, $V_{PP}$=1800V, f=1.5 kHz, and $V_{AC}$ is a sin wave).

By performing beta-printing of halftone of 25% on general paper having a size of A4 in indoor environments having a temperature 23° C. and a humidity of 50%, a durability experiment on 10 k (10000) sheets of monochrome is performed.

A case where an image having a desired (practically usable) printing concentration is obtained with the naked eye is denoted by o, because it is determined that the charging is good, and a case where a hole is generated in the photosensitive body by leakage and a case where periodic image spots of the charging roller are generated in an image is denoted by x, because it is determined that the charging is bad.

The charging rollers of the examples of Nos. 1 to 9 and 11 to 15 were denoted by o, because it is determined that the charging is good. In the charging roller of the example of No. 10, since the conductive layer is too thin, the conductive layer is not formed on the edge of the concave portion, the core is exposed from the edge of the concave portion, and the charge leakage occurs immediately after a printing process begins, thereby obtaining a bad result. This is because the film thickness of the conductive layer is too thin, not because the concave portion is formed on the core of the present invention. Accordingly, the film thickness of the conductive layer need be set to a predetermined thickness. This film thickness may be adequately set according to circumstances. In order to prevent the charge leakage, it is preferable that the edge of the concave portion is chamfered (C-cut) and the conductive layer is formed on the edge of the concave portion.

In the charging rollers of the comparative examples of Nos. 16 to 18 in which the concave portions were not formed, periodic image spots of the charging roller were formed on the image upon 10 k sheets of print, thereby obtaining a bad result.

By this experiment, in the non-contact charging the photosensitive body 2 using the charging roller 3*a*, it is verified that, when the concave portions are formed in the both ends of the charging roller 3*a*, at least one of the above-described effects of the present invention is obtained.

The charging roller according to the first embodiment of the present invention is used for an image forming apparatus such as an electrophotography, an electrostatic copier, a printer, and a facsimile, and, as the charging roller for charging the photosensitive body at a predetermined charging gap in a non-contact manner, a charging roller in which a conductive layer of a charging part is formed on a metal shaft may be preferably used.

Hereinafter, a charging roller according to a second embodiment of the present invention will be described. The second embodiment will be described with reference to FIGS. 2A to 3C, similar to the first embodiment. The charging roller according to the second embodiment uses a elastic insulating member instead of the insulating layer of the charging roller according to the first embodiment.

As shown in FIG. 2A, the non-contact charging roller 3*a* includes a core 3*c*. The core 3*c* is, for example, composed of a conductive shaft such as a metal shaft. For example, a conductive shaft obtained by coating the surface of SUM22 with Ni may be used.

Annular concave portions 3*d* and 3*e* are formed in the outer circumferential surfaces of the both ends of the core 3*c*. A conductive layer 3*g* is formed by coating the outer circumferential surface of a center portion 3*f* of the core 3*c* between the concave portions 3*d* and 3*e* with a conductive coating material using a spray coating method. In this case, the conductive coating material enters into the concave portions 3*d* and 3*e* to partially cover the concave portions 3*d* and 3*e* of the core 3*c*. The conductive layer 3*g* configures a charging part for charging the photosensitive body 2 at a predetermined charging gap G in a non-contact manner.

In addition, insulating layers 3*j* and 3*k* are formed by fixing a elastic insulating member on the outer circumferential surfaces of the both ends 3*h* and 3*i* of the core 3*c* outer than the concave portions 3*d* and 3*e*. In this case, the elastic insulating member enters into the concave portions 3*d* and 3*e* to partially cover the concave portions 3*d* and 3*e* of the core 3*c* and to cover the both ends of the core 3*c*. The outer diameters of the insulating layers 3*j* and 3*k* are set to be equal to each other. The film thickness of the insulating layers 3*j* and 3*k* is set to be larger than that of the conductive layer 3*g*. Accordingly, the insulating layers 3*j* and 3*k* are in contact with the photosensitive body 2 to configure a gap part for setting the predetermined charging gap G between the conductive layer 3*g* and the photosensitive body 2 based on a film thickness difference. The insulating layers 3*j* and 3*k* configuring the gap part are formed on the outer circumferential surface of the core 3*c*.

As shown in FIG. 2B, the depth $t_1$ of the concave portion 3*d* is set to be larger than a sum of the thickness $t_2$ of the conductive layer 3*g* and the film thickness $t_3$ of the insulating layer 3*j* ($t_1>t_2+t_3$). Accordingly, the depth $t_1$ of the concave portion 3*d* is set to be larger than any one of the film thickness $t_2$ of the conductive layer 3*g* and the film thickness $t_3$ of the insulating layer 3*j* ($t_1>t_2$, $t_1>t_3$, and $t_3>t_2$).

In addition, an edge of the concave portion 3*d* of the core 3*c* is chamfered (C-cut) c. Edges of the end 3*h* of the core 3*c* are also chamfered (C-cut) c. The chamfer c is generally called an R part and defined as a rounded edge obtained by cutting the edge in a curved shape. The chamfer c may be formed by cutting the edge in a flat slope surface.

Although FIG. 2B shows only the concave portion 3*d* and the insulating layer 3*j* of one end 3*h*, the concave portion 3*e* and the insulating layer 3*k* of the other end 3*i* are formed similar to the concave portion 3*d* and the insulating layer 3*j* of the end 3*h*.

The conductive layer 3*g* and the insulating layer 3*j* and 3*k* may be formed on the core 3*c* by forming the conductive layer 3*g* and then forming the insulating layers 3*j* and 3*k*, and vice versa.

According to the non-contact charging roller 3*a* having the above-described configuration, since the insulating members 3*j* and 3*k* composed of the elastic insulating member and configuring the gap part are formed on the outer circumferential surface of the core 3*c*, it is possible to simply set the charging gap G with stability and high precision. In addition; since the concave portions 3*d* and 3*e* of the core 3*c* are not directly related to the charging gap G, the concave portions need not be manufactured with high precision and thus the charging roller 3*a* can be manufactured at low cost.

In addition, the insides of the annular concave portions 3*d* and 3*e* formed in the both ends 3*h* and 3*i* of the core 3*c* are coated with the conductive coating material and the insulating coating material. In a state that the insulating layers 3*j* and 3*k* are in contact with the photosensitive body 2, since portions of the concave portions 3*d* and 3*e* coated with the conductive coating material are distant from the photosensitive body 2, the charging gap G for non-contact charging is not formed and discharging onto the photosensitive body 2 is not performed. Thus, the portions of the concave portions 3*d* and 3*e* coated with the conductive coating material do not contribute to the non-contact charging. Accordingly, the concave portions 3*d* and 3*e* can be used as a coating boundary of the conductive coating material and a fixing boundary of the elastic insulating member and thus the conductive coating material and the insulating coating material can be easily formed with high precision.

In a case where the concave portions 3*d* and 3*e* are not formed in the both ends 3*h* and 3*i* of the core 3*c*, when the insulating layers 3*j* and 3*k* are formed by fixing the elastic insulating member to the both ends 3*h* and 3*i*, for example, with an adhesive as shown in FIG. 2C, the film thickness of inner ends 3*m* and 3*n* of the insulating layers 3*j* and 3*k* shows a tendency to thicken due to a surface tension at the time of drying the adhesive, or, when the insulating layers 3*j* and 3*k* are formed using a thermal shrinkage tube as the elastic insulating member, the film thickness of the inner ends 3*m* and 3*n* of the insulating layer 3*i* and 3*k* shows a tendency to thicken by shrinkage of the thermal shrinkage tube. Accordingly, it is impossible to form the insulating layer 3*j* and 3*k* configuring the gap part with a uniform film thickness, that is, to set the uniform charging gap G.

Since the film thickness of the both ends of the conductive layer 3*g* shows a tendency to thicken due to a surface tension at the time of drying the conductive coating material after coating, it is impossible to form the conductive layer 3*g* with a uniform film thickness, that is, to set the uniform charging gap G. In contrast, according to the charging roller 3*a* of this example, since the concave portions 3*d* and 3*e* are formed in the both ends 3*h* and 3*i* of the core 3*c*, the conductive coating material and the elastic insulating member enter into the concave portions 3*d* and 3*e*. Accordingly, although the film thicknesses of the ends of the conductive layer 3*g* and the insulating layers 3*j* and 3*k* show a tendency to thicken due to the surface tension after forming and drying the conductive coating material and after fixing the elastic insulating member, this tendency is absorbed by the concave portions 3*d* and 3*e* and thus the film thickness of the conductive layer 3*g* configuring the charging part and the film thickness of the insulating layers 3*j* and 3*k* configuring the gap part become uniform. Accordingly, it is possible to perform better charging.

Since the edges of the concave portions 3*d* and 3*e* of the core 3*c* are chamfered c, in the edges, a gradient from the outer circumferential surface of the core 3*c* to the concave portions 3*d* and 3*e* does not rapidly vary. Accordingly, the edges of the concave portions 3*d* and 3*e* of the core 3*c* can be surely covered with the conductive coating material and the elastic insulating material. Accordingly, it is possible to more surely prevent charge leakage from the edges of the concave portions 3*d* and 3*e* of the core 3*c* and to reduce the film thickness of the conductive layer 3*g*.

Since the depth $t_1$ of the concave portions 3*d* and 3*e* is set to be larger than the sum of the film thickness $t_2$ of the conductive layer 3*g* and the film thickness $t_3$ of the insulating layers 3*j* and 3*k*, the depth of the concave portions 3*d* and 3*e* is larger than the film thickness when the conductive coating material and the insulating coating material are formed. Accordingly, it is possible to prevent the conductive coating material and the elastic insulating member from being protruded from the concave portions 3*d* and 3*e* and to stably form the charging gap G by the insulating layers 3*j* and 3*k* with high precision. By setting the depth of the concave portions 3*d* and 3*e* in consideration that the film thickness of the ends of the conductive layer 3*g* and the insulating layers 3*j* and 3*k* shows a tendency to thicken, it is possible to more surely form the charging gap G with stability and high precision.

FIGS. 3A to 3C show another example and a comparative example of the charging roller according to the second embodiment of the present invention, where FIG. 3A is a cross-sectional view taken along an axial direction, FIG. 3B is a partial enlarged cross-sectional view of FIG. 3A, and FIG. 3C is a cross-sectional view taken along the axial direction of the comparative example. The same elements as those shown in FIGS. 2A to 2C are denoted by the same reference numerals and their detailed description will be omitted.

In the charging roller 3*a* of the example shown in FIGS. 2A and 2B, the conductive layer 3*g* is formed on the outer circumferential surface of the center portion 3*f* of the core 3*c* between the concave portions 3*d* and 3*e* and the insulating layers 3*i* and 3*k* are formed on the outer circumferential surfaces of the both ends 3*h* and 3*i* of the core 3*c* outer than the concave portions 3*d* and 3*e*, whereas, in the charging roller 3*a* of the example shown in FIGS. 3A and 3B, the conductive layer 3*g* is formed on all the outer circumferential surface of the center portion 3*f* of the core 3*c*, the outer circumferential surfaces of the concave portions 3*d* and 3*e* of the core 3*c*, and the outer circumferential surfaces of the both ends 3*h* and 3*i* of the core 3*c*, and the insulating layer 3*j* and 3*k* are formed on (the outer circumferential surface of) the conductive layers 3*g* formed on the outer circumferential surfaces of the both ends 3*h* and 3*i* of the core 3*c*. In this case, concave portions 3*o* and 3*p* are formed on the conductive layer 3*g* formed on the outer circumferential surface of the concave portions 3*d* and 3*e* of the core 3*c* in correspondence with the concave portions 3*d* and 3*e* and the insulating coating material partially enters into the concave portions 3*o* and 3*p*.

In the charging roller 3*a* of this example, the outer circumferential surface of the core 3*c* is coated with the conductive coating material and the elastic insulating member is then fixed thereon. Even in the charging roller 3*a*, as shown in FIG. 3C, when the concave portions 3*d* and 3*e* are not formed in the both ends of the core 3*c*, the film thickness of inner ends 3*m* and 3*n* of the insulating layers 3*j* and 3*k* shows a tendency to thicken after fixing the elastic insulating material. Accordingly, the film thickness of the insulating layers 3*j* and 3*k* configuring the gap part cannot become uniform.

The other configuration and effect of the charging roller 3*a* of this example is similar to those shown in FIGS. 2A and 2B.

Next, experimental examples and comparative examples of the non-contact charging roller according to the second embodiment of the present invention will be described. The charging rollers of the experimental examples which belong to the second embodiment of the present invention and the charging rollers of the comparative examples which do not belong to the second embodiment of the present invention are manufactured and an experiment for verifying that the charging roller according to the second embodiment can obtain the above-described effect is performed using the charging rollers 3*a*.

The charging rollers of the experimental examples and the comparative examples used in the experiment and the experimental result are shown in Table 4.

TABLE 4

| No. | Manufacturing method | Film thickness of conductive layer | Thickness of gap | Gap member | Concave portion | Result | Note |
|---|---|---|---|---|---|---|---|
| 1 | Manufacturing method ① | 15 | 20 | Gap ① | Formed, C cut | ○ | |
| 2 | Manufacturing method ① | 30 | 20 | Gap ① | Formed, C cut | ○ | |
| 3 | Manufacturing method ① | 45 | 20 | Gap ② | Formed, C cut | ○ | |
| 4 | Manufacturing method ② | 15 | 20 | Gap ① | Formed, C cut | ○ | |
| 5 | Manufacturing method ② | 30 | 20 | Gap ① | Formed, C cut | ○ | |
| 6 | Manufacturing method ② | 45 | 20 | Gap ② | Formed, C cut | ○ | |
| 7 | Manufacturing method ③ | 15 | 20 | Gap ① | Formed, C cut | ○ | |
| 8 | Manufacturing method ③ | 30 | 20 | Gap ① | Formed, C cut | ○ | |

TABLE 4-continued

| No. | Manufacturing method | Film thickness of conductive layer | Thickness of gap | Gap member | Concave portion | Result | Note |
|---|---|---|---|---|---|---|---|
| 9 | Manufacturing method ③ | 45 | 20 | Gap ② | Formed, C cut | ○ | |
| 10 | Manufacturing method ① | 5 | 20 | Gap ① | Formed, Straight | X | If the conductive layer is too thin, X |
| 11 | Manufacturing method ① | 10 | 20 | Gap ① | Formed, straight | ○ | |
| 12 | Manufacturing method ① | 30 | 20 | Gap ② | Formed, straight | ○ | |
| 13 | Manufacturing method ① | 40 | 20 | Gap ① | Formed, straight | ○ | |
| 14 | Manufacturing method ② | 10 | 20 | Gap ① | Formed, straight | ○ | |
| 15 | Manufacturing method ③ | 10 | 20 | Gap ② | Formed, straight | ○ | |
| 16 | Manufacturing method ① | 40 | 20 | Gap ① | None | X | Gap is shifted |
| 17 | Manufacturing method ② | 30 | 20 | Gap ① | None | X | Gap is shifted |
| 18 | Manufacturing method ③ | 10 | 20 | Gap ② | None | X | Gap is shifted |

In Table 4, Nos. 1 to 15 denote the charging rollers of the experimental examples in which the concave portions 3*d* and 3*e* are formed in the both ends of the core 3*c*, as shown in FIGS. 2A and 2B and FIGS. 3A and 3B, and Nos. 16 to 18 denote the charging rollers of the comparative examples in which the concave portions 3*d* and 3*c* are not formed in the both ends of the core 3*c*, as shown in FIG. 2C and FIG. 3C. In Nos. 1 to 9 of the experimental examples, the edges of the concave portions 3*d* and 3*e* are C-cut, and, in the rest of Nos. 10 to 15, the edges of the concave portions 3*d* and 3*e* are not C-cut and are straight.

The shaft diameter of the core of each charging roller (diameter of a portion of the core 3*c* on which the conductive layers 3*g* is formed) of each example was ϕ8 mm. The core 3*c* obtained by coating the surface of SUM22 with Ni was used. The depth of concave portion formed in the core was set to 100 μm in the charging rollers of Nos. 1, 4, 7, 10, 11, 14, and 15, 125 μm in the charging rollers of Nos. 2, 5, 8, and 12, 150 μm in the charging rollers of Nos. 3, 6, 9, and 13.

The conductive coating material and the elastic insulating member shown in Table 5 were used.

TABLE 5

| | |
|---|---|
| Conductive material (charging part) | Conductive $SnO_2$ 19%<br>PU 18%<br>Ion conductive material ⌈YYP-12⌋ 3%<br>Water 60% |
| Insulating material (gap part) | Gap ①: thermal shrinkage tube made of PET (film thickness is 25 μm when gap is 20 μm)<br>Gap ②: rubber made of PU (film thickness is 50 μm when gap is 20 μm) |

As shown in Table 5, the conductive coating material is coating liquid including 19 wt % of conductive $SnO_2$, 18 wt % of polyurethane (PU), 3 wt % of an ion conductive material, and 60 wt % of water. The conductive $SnO_2$ is made by Jemco Inc. shown in Table 3 and the detailed contents are disclosed in a homepage of Jemco Inc.

TABLE 6

| Name | Physicality | Use |
|---|---|---|
| Tin-antimony oxide Sn—Sb Oxides Trademark T-1 | 1) aspect: grayish blue powder<br>2) specific resistance of powder: 1-3 Ω · cm (100 kg/cm$^2$ upon applying pressure)<br>3) particle shape: spherical<br>4) primary particle diameter: 0.02 μm<br>5) specific gravity: 6.6 | Antistatic agent Since a particle diameter is smaller than the wavelength of visible light, a transparent conductive film can be formed in a thin film shape. |
| Aqueous dispersion of tin-antimony oxide Sn—Sb Oxides Dispersed Trademark TDL | 1) aspect: blue liquid (water system)<br>2) solid concentration: 17 wt %<br>3) solid average particle diameter: 100 nm<br>4) specific gravity: 1.17 | Antistatic agent This is aqueous dispersion of antimony oxide doped tin oxide A transparent conductive film can be formed. |
| Tin-antimony oxide coating material/dispersion Liquid Paint Sn—Sb Oxides Paint Trademark ES | 1) aspect: blue liquid<br>2) coating film surface resistance (measuring method of this corporation) $10^{5-9}$ Ω/□ | 1) antistatic agent<br>2) near infrared ray cut material Since the particle diameter of a coating material is smaller than the wavelength of visible light, a high transparent conductive film |

TABLE 6-continued

| Name | Physicality | Use |
|---|---|---|
| | | and a near infrared ray cut material can be formed. |
| Titanium oxide/tin-antimony oxide $TiO_2$/Sn—Sb Oxides Trademark W-1 | 1) aspect: light gray powder 2) specific resistance of powder: 3-10 Ω · cm (100 kg/cm$^2$ upon applying pressure) 3) particle shape: spherical 4) primary particle diameter: 0.2 μm 5) specific gravity: 4.6 | Antistatic agent In kneading with resin, this is white or colorable conductive material. |

The conductive $SnO_2$ used in the experimental examples and the comparative examples is trademark "T-1" made by Jemco, Inc. "T-1" is tin-antimony oxide. In the second embodiment, the other conductive $SnO_2$ may be used.

The ion conductive material is to apply conductivity to the conductive coating material. The ion conductive material used in the experimental examples and the comparative examples is "YYP-12" (made by Marubishi Oil Chemical Co., Ltd.).

In the elastic insulating member which is the gap member configuring the insulating layers 3*j* and 3*k*, the gap member (1) is a thermal shrinkage tube made of PET and the gap member (2) is elastic rubber made of polyurethane (PU) resin. In this case, the film thickness of the thermal shrinkage tube made of PET before fixing is 50 μm and the film thickness thereof after fixing is 20 μm (That is, the charging gap G is 20 μm).

In the method of manufacturing the charging rollers of the respective examples, the charging rollers of Nos. 1 to 3, 10 to 13, and 16 were manufactured using the manufacturing method (1) of fixing the elastic insulating member to the both ends of the core to form the insulating layer and coating the center portion of the core with the conductive coating material using the spray coating method to form the conductive layer. The charging rollers of Nos. 4 to 6, 14 and 17 were manufactured using the manufacturing method (2) of coating the center portion of the core with the conductive coating material using the spray coating method to form the conductive layer and fixing the elastic insulating member to the both ends of the core to form the insulating layer. In the manufacturing method (2), the conductive layer does not exist between the insulating layer and the core. The charging rollers of Nos. 7 to 9, 15, and 18 were manufactured using a manufacturing method (3) of coating the center portion, the concave portion, and the both ends of the core with the conductive coating material using the spray coating method to form the conductive layer, and fixing the elastic insulating member to the both ends of the core to form the insulating layer. In the manufacturing method (3), the conductive layer exists between the insulating layer and the core. The manufacturing methods ① to ③ in Table 1 correspond to the above-described manufacturing methods (1) to (3), respectively. The gap members ① and ② (in Tables 4 and 5 correspond to the above-described methods (1) and (2).

The photosensitive body was made of the same material as LP-9000C made by Seiko Epson Corporation. The film thickness of the photosensitive body was set to 23 μm, the diameter of the photosensitive body was set to ϕ24 mm, and the circumferential velocity of the photosensitive body was set to 250 mm/sec.

An experimental apparatus of the image forming apparatus had the same configuration as that of the LP-9000C. A voltage Vc (V) applied to the charging roller 3*a* was set to $$V_C = V_{DC} + V_{AC} = -650 + (1/2)V_{PP} \cdot \sin 2\pi ft$$

obtained by overlapping an AC component $V_{AC}$ (V) with a DC component $V_{DC}$ (V) (where, $V_{PP}$=1800V, f=1.5 kHz, and $V_{AC}$ is a sin wave).

By performing beta-printing of halftone of 25% on general paper having a size of A4 in indoor environments having a temperature 23° C. and a humidity of 50%, a durability experiment on 10 k (10000) sheets of monochrome is performed.

A case where an image having a desired (practically usable) printing concentration is obtained is with the naked eye denoted by 0, because it is determined that the charging is good, and a case where a hole is generated in the photosensitive body by leakage and a case where the elastic insulating member is shifted (deviated in the axial direction of the charging roller) to cause a charging failure is denoted by x, because it is determined that the charging is bad.

The charging rollers of the examples of Nos. 1 to 9 and 11 to 15 were denoted by o, because it is determined that the charging is good. In the charging roller of the example of No. 10, since the film thickness of the conductive layer is too thin, the conductive layer is not formed on the edge of the concave portion, the core is exposed from the edge of the concave portion, and the charge leakage occurs immediately after a printing process begins, thereby obtaining a bad result. This is because the film thickness of the conductive layer is too thin, not because the concave portion is formed on the core of the present invention. Accordingly, the film thickness of the conductive layer need be set to a predetermined thickness. This film thickness may be adequately set according to circumstances. In order to prevent the charge leakage, it is preferable that the edge of the concave portion is chamfered (C-cut) and the conductive layer is formed on the edge of the concave portion.

In the charging rollers of the comparative examples of Nos. 16 to 18 in which the concave portions were not formed, the elastic insulating member configuring the insulating layer is shifted from a regular position in the axial direction of the charging roller upon 10 k sheets of print, thereby obtaining a bad result.

By this experiment, in the non-contact charging the photosensitive body 2 using the charging roller 3*a*, it is verified that, when the concave portions are formed in the both ends of the charging roller 3*a*, at least one of the above-described effects of the present invention is obtained.

The charging roller according to the second embodiment of the present invention is used for an image forming apparatus such as an electrophotography, an electrostatic copier, a printer, and a facsimile, and, as the charging roller for charging the photosensitive body at a predetermined charging gap in a non-contact manner, a charging roller in which a conductive layer of a charging part is formed on a metal shaft may be preferably used.

Hereinafter, a charging roller according to a third embodiment of the present invention will be described. The same elements as the first embodiment are denoted by the same reference numerals.

Figure 4A:
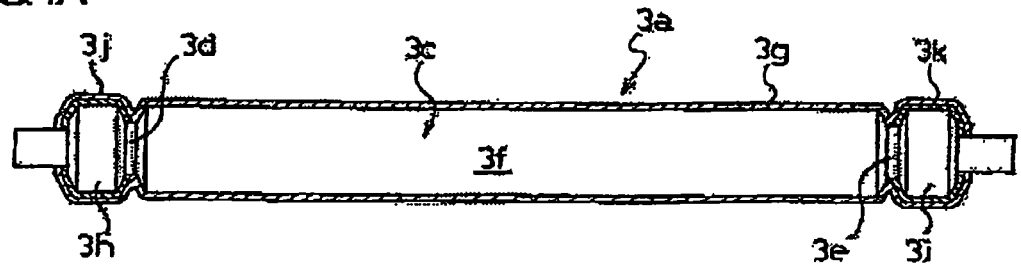
FIG. 4A is a cross-sectional view taken along an axial direction of a charging roller according to a third embodiment of the present invention.

As shown in FIG. 4A, the non-contact charging roller 3*a* includes a core 3*c*. The core 3*c* is, for example, composed of a conductive shaft such as a metal shaft. For example, a conductive shaft obtained by coating the surface of SUM22 with Ni may be used.

Annular concave portions 3*d* and 3*e* are formed in the outer circumferential surfaces of the both ends of the core 3*c*. Insulating layers 3*j* and 3*k* made of an insulating member are formed on the outer circumferential surfaces of both ends 3*h* and 3*i* outer than the concave portions 3*d* and 3*e*. In this case, the insulating member may be an insulating coating material or a elastic insulating member. The insulating member enters into the concave portions 3*d* and 3*e* to partially cover the concave portions 3*d* and 3*e* of the core 3*c* and to cover the both ends of the core 3*c*. The outer diameters of the insulating layers 3*i* and 3*k* are set to be equal to each other.

A conductive layer 3*g* is formed by coating the outer circumferential surfaces of the insulating layer 3*j* and 3*k*, the concave portions 3*d* and 3*e* of the core 3*c*, and the outer circumferential surface of a center portion 3*f* of the core 3*c* between the concave portions 3*d* and 3*e* with a conductive coating material using a spray coating method. Accordingly, when the conductive layer 3*g* is in contact with the photosensitive body 2, the insulating layers 3*j* and 3*k* and the conductive layer 3*g* formed on the outer circumference surfaces of the insulating layers 3*j* and 3*k* configure a gap part for setting the predetermined charging gap G between the conductive layer 3*g* and the photosensitive body 2 based on the film thickness of the insulating layers 3*j* and 3*k* The insulating layers 3*j* and 3*k* configuring the gap part are formed on the outer circumferential surface of the core 3*c*. In addition, the conductive layer 3*g* formed on the outer circumferential surface of the center portion 3*f* of the core 3*c* configures a charging part for non-contact charging at the predetermined charging gap G.

Figure 4B:
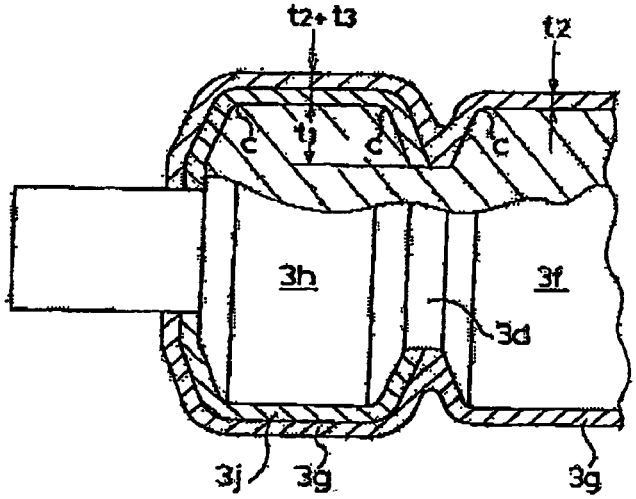
FIG. 4B is a partial enlarged cross-sectional view of FIG. 4A.

As shown in FIG. 4B, the depth $t_1$ of the concave portion 3*d* is set to be larger than a sum of the thickness $t_2$ of the conductive layer 3*g* and the film thickness $t_3$ of the insulating layer 3*j* ($t_1>t_2+t_3$). Accordingly, the depth $t_1$ of the concave portion 3*d* is set to be larger than any one of the film thickness $t_2$ of the conductive layer 3*g* and the film thickness $t_3$ of the insulating layer 3*j* ($t_1>t_2$, $t_1>t_3$, and $t_3>t_2$).

In addition, an edge of the concave portion 3*d* of the core 3*c* is chamfered (C-cut) c. Edges of the end 3*h* of the core 3*c* are also chamfered (C-cut) c. The chamfer c is generally called an R part and defined as a rounded edge obtained by cutting the edge in a curved shape. The chamfer c may be formed by cutting the edge in a flat slope surface.

Although FIG. 4B shows only the concave portion 3*d* and the insulating layer 3*j* of one end 3*h*, the concave portion 3*e* and the insulating layer 3*k* of the other end 3*i* are formed similar to the concave portion 3*d* and the insulating layer 3*j* of the end 3*h*.

According to the non-contact charging roller 3*a* having the above-described configuration, since the insulating members 3*j* and 3*k* configuring the gap part are formed on the outer circumferential surface of the core 3*c*, it is possible to simply set the charging gap G with stability and high precision. In addition, since the concave portions 3*d* and 3*e* of the core 3*c* are not directly related to the charging gap G, the concave portions need not be manufactured with high precision and thus the charging roller 3*a* can be manufactured at low cost.

In addition, the insides of the annular concave portions 3*d* and 3*e* formed in the both ends 3*h* and 3*i* of the core 3*c* are coated with the conductive coating material and the insulating member. In a state that the insulating layers 3*j* and 3*k* are in contact with the photosensitive body 2, since portions of the concave portions 3*d* and 3*e* coated with the conductive coating material are distant from the photosensitive body 2, the charging gap G for non-contact charging is not formed and discharging onto the photosensitive body 2 is not performed. Accordingly, the portions of the concave portions 3*d* and 3*e* coated with the conductive coating material do not contribute to the non-contact charging. Accordingly, the concave portions 3*d* and 3*e* can be used as a coating boundary of the conductive coating material and a mounting boundary of the insulating member (coating boundary when the insulating member is the insulating coating material) and thus coating of the conductive coating material and fixing of the insulating coating material can be easily performed with high precision.

Figure 4C:
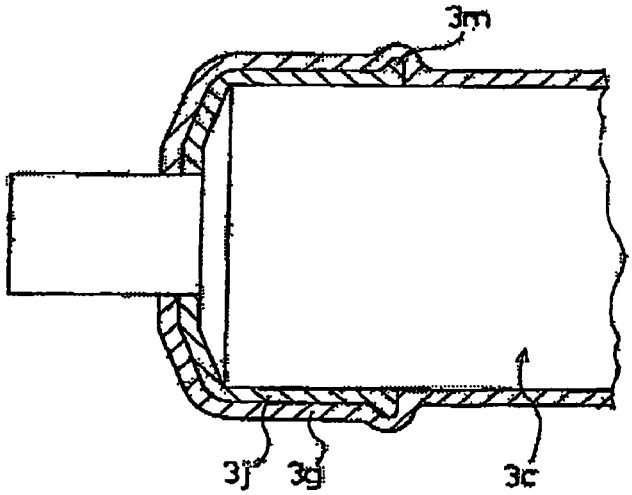
FIG. 4C is a cross-sectional view taken along an axial direction of a comparative example of the charging roller of the third embodiment of the present invention.

In a case where the concave portions 3*d* and 3*e* are not formed in the both ends 3*h* and 3*i* of the core 3*c*, when the insulating layers 3*j* and 3*k* are formed by coating the both ends 3*h* and 31 with the insulating coating material as shown in FIG. 4C, the film thickness of an inner end 3*m* of the insulating layers 3*j* and 3*k* (insulating layer 3*k* is not shown) shows a tendency to thicken due to a surface tension at the time of drying the insulating coating material after coating. In addition, when the insulating layers 3*j* and 3*k* are formed by fixing the elastic insulating member to the both ends 3*h* and 3*i*, for example, with an adhesive, the film thickness of the inner end 3*m* of the insulating layers 3*j* and 3*k* (insulating layer 3*k* is not shown) shows a tendency to thicken due to a surface tension at the time of drying the adhesive, or, when the insulating layers 3*j* and 3*k* are formed using a thermal shrinkage tube as the elastic insulating member, the film thickness of the inner end 3*m* of the insulating layer 3*i* and 3*k* (insulating layer 3*k* is not shown) shows a tendency to thicken by shrinkage of the thermal shrinkage tube. Accordingly, it is impossible to form the insulating layer 3*j* and 3*k* configuring the gap part with a uniform film thickness, that is, to set the uniform charging gap G. Since the film thickness of the both ends of the conductive layer 3*g* shows a tendency to thicken due to a surface tension at the time of drying the conductive coating material after coating, it is impossible to form the conductive layer 3*g* with a uniform film thickness, that is, to set the uniform charging gap G.

In contrast, according to the charging roller 3*a* of this example, since the concave portions 3*d* and 3*e* are formed in the both ends 3*h* and 3*i* of the core 3*c*, the insulating member enters into the concave portions 3*d* and 3*e*. Accordingly, although the film thickness of the ends of the insulating layers 3*j* and 3*k* shows a tendency to thicken after mounting the insulating member, this tendency is absorbed by the concave portions 3*d* and 3*e* and thus the film thickness of the conductive layer 3*g* configuring the charging part and the film thickness of the insulating layers 3*j* and 3*k* configuring the gap part become uniform. Accordingly, it is possible to perform better charging.

Since the edges of the concave portions 3*d* and 3*e* of the core 3*c* are chamfered c, in the edges, a gradient from the outer circumferential surface of the core 3*c* to the concave portions 3*d* and 3*e* does not rapidly vary. Accordingly, the edges of the concave portions 3*d* and 3*e* of the core 3*c* can be surely covered with the conductive coating material and the insulating member. Accordingly, it is possible to more surely prevent charge leakage from the edges of the concave portions 3*d* and 3*e* of the core 3*c* and to reduce the film thickness of the conductive layer 3*g*.

Since the depth $t_1$ of the concave portions 3*d* and 3*e* is set to be larger than the sum of the film thickness $t_2$ of the conductive layer 3*g* and the film thickness $t_3$ of the insulating layers 3*j* and 3*k*, the depth of the concave portions 3*d* and 3*e* is larger than the film thickness when the conductive coating material and the insulating member are formed. Accordingly, it is possible to prevent the conductive coating material and the insulating member from being protruded from the concave portions 3*d* and 3*e* and to stably form the charging gap G by the insulating layers 3*j* and 3*k* with high precision. By setting the depth of the concave portions 3*d* and 3*e* in consideration that the film thickness of the ends of the conductive layer 3*g* and the insulating layers 3*j* and 3*k* shows a tendency to thicken, it is possible to more surely form the charging gap G with stability and high precision.

Next, experimental examples and comparative examples of the non-contact charging roller according to the third embodiment of the present invention will be described. The charging rollers of the experimental examples which belong to the third embodiment of the present invention and the charging rollers of the comparative examples which do not belong to the third embodiment of the present invention are manufactured and an experiment for verifying that the charging roller according to the third embodiment can obtain the above-described effect is performed using the charging rollers 3*a*.

The charging rollers of the experimental examples and the comparative examples used in the experiment and the experimental result are shown in Table 7.

TABLE 7

| No. | Film thickness of conductive layer | Concave portion | Result | Note |
|---|---|---|---|---|
| 1 | 2 | Formed, C cut | x | If the conductive layer is too thin, x |
| 2 | 3 | Formed, C cut | x | If the conductive layer is too thin, x |
| 3 | 4 | Formed, C cut | x | If the conductive layer is too thin, x |
| 4 | 5 | Formed, C cut | ○ | |
| 5 | 6 | Formed, C cut | ○ | |
| 6 | 8 | Formed, C cut | ○ | |
| 7 | 10 | Formed, C cut | ○ | |
| 8 | 20 | Formed, C cut | ○ | |
| 9 | 40 | Formed, C cut | ○ | |
| 10 | 60 | Formed, C cut | ○ | |
| 11 | 70 | Formed, C cut | ○ | |
| 12 | 2 | None | x | If the conductive layer is too thin, x |
| 13 | 3 | None | x | If the conductive layer is too thin, x |
| 14 | 4 | None | x | If the conductive layer is too thin, x |
| 15 | 5 | None | x | Charging spot |
| 16 | 6 | None | x | Charging spot |
| 17 | 8 | None | x | Charging spot |
| 18 | 10 | None | x | Charging spot |
| 19 | 20 | None | x | Charging spot |
| 20 | 40 | None | x | Charging spot |
| 21 | 60 | None | x | Charging spot |
| 22 | 70 | None | x | Charging spot |

In Table 7, Nos. 1 to 11 denote the charging rollers of the experimental examples in which the concave portions 3*d* and 3*e* are formed in the both ends of the core 3*c* and the edges of the concave portions 3*d* and 3*e* are C-cut, as shown in FIGS. 4A and 4B, and Nos. 12 to 22 denote the charging rollers of the comparative examples in which the concave portions 3*d* and 3*c* are not formed in the both ends of the core 3*c*, as shown in FIG. 4C.

The shaft diameter of the core of each charging roller (diameter of a portion of the core 3*c* on which the conductive layers 3*g* is formed) of the examples was ϕ8 mm. The core 3*c* obtained by coating the surface of SUM22 with Ni was used. The depth of concave portion formed in the core was set to 100 μm in the charging rollers of Nos. 1 to 6 and 12 to 17, 125 μm in the charging rollers of Nos. 7, 8, 18 and 19, 150 μm in the charging rollers of Nos. 9 to 11 and 20 to 22.

The conductive coating material and the insulating member shown in Table 8 were used.

TABLE 8

| | |
|---|---|
| Conductive material (charging part) | Conductive $SnO_2$ 19%<br>PU 18%<br>Ion conductive material ⌈YYP-12⌋ 3%<br>Water 60% |
| Insulating material (gap part) | PI spray coating film (film thickness 20 μm) |

As shown in Table 2, the conductive coating material is coating liquid including 19 wt % of conductive $SnO_2$, 18 wt % of polyurethane (PU), 3 wt % of an ion conductive material, and 60 wt % of water. The conductive $SnO_2$ is made by Jemco Inc. shown in Table 3 and the detailed contents are disclosed in a homepage of Jemco Inc.

TABLE 9

| Name | Physicality | Use |
|---|---|---|
| in-antimony oxide Sn—Sb Oxides Trademark T-1 | 1) aspect: grayish blue powder<br>2) specific resistance of powder: 1-3 Ω · cm (100 kg/cm$^2$ upon applying pressure)<br>3) particle shape: spherical<br>4) primary particle diameter: 0.02 μm<br>5) specific gravity: 6.6 | Antistatic agent Since a particle diameter is smaller than the wavelength of visible light, a transparent conductive film can be formed in a thin film shape. |
| Aqueous dispersion of tin-antimony oxide Sn—Sb Oxides Dispersed Trademark TDL | 1) aspect: blue liquid (water system)<br>2) solid concentration: 17 wt %<br>3) solid average particle diameter: 100 nm<br>4) specific gravity: 1.17 | Antistatic agent This is aqueous dispersion of antimony oxide doped tin oxide A transparent conductive film can be formed. |
| Tin-antimony oxide coating material/dispersion Liquid Paint Sn—Sb Oxides Paint Trademark ES | 1) aspect: blue liquid<br>2) coating film surface resistance (measuring method of this corporation) $10^{5-9}$ Ω/□ | 1) antistatic agent<br>2) near infrared ray cut material Since the particle diameter of a coating material is smaller than the wavelength of visible light, a high transparent conductive film and a near infrared ray cut material can be formed. |

TABLE 9-continued

| Name | Physicality | Use |
|---|---|---|
| Titanium oxide/tin-antimony oxide $TiO_2$/Sn—Sb Oxides Trademark W-1 | 1) aspect: light gray powder 2) specific resistance of powder: 3-10 Ω · cm (100 kg/cm$^2$ upon applying pressure) 3) particle shape: spherical 4) primary particle diameter: 0.2 μm 5) specific gravity: 4.6 | Antistatic agent In kneading with resin, this is white or colorable conductive material. |

The conductive $SnO_2$ used in the experimental examples and the comparative examples is trademark "T-1" made by Jemco, Inc. "T-1" is tin-antimony oxide. In the third embodiment, the other conductive $SnO_2$ may be used.

The ion conductive material is to apply conductivity to the conductive coating material. The ion conductive material used in the experimental examples and the comparative examples is "YYP-12" (made by Marubishi Oil Chemical Co., Ltd.).

The insulating member configuring the gap part is polyimide (PI) resin which is the insulating coating material. The insulating layer having a film thickness of 20 μm is formed using the polyimide (PI) resin by the spray coating method.

In the method of manufacturing the charging rollers of the respective examples, the both ends of the core was coated with the insulating coating material using the spray coating method to form the insulating layer and the outer circumferential surface of the insulating layer, the concave portions of the core, and the center portion of the core were coated with the conductive coating material using the spray coating method to form the insulating layer.

The photosensitive body was made of the same material as LP-9000C made by Seiko Epson Corporation. The film thickness of the photosensitive body was set to 23 μm, the diameter of the photosensitive body was set to ϕ24 mm, and the circumferential velocity of the photosensitive body was set to 250 mm/sec.

An experimental apparatus of the image forming apparatus had the same configuration as that of the LP-9000C. A voltage Vc (V) applied to the charging roller 3*a* was set to $$V_C = V_{DC} + V_{AC} = -650 + (1/2)V_{PP} \cdot \sin 2\pi ft$$

obtained by overlapping an AC component $V_{AC}$ (V) with a DC component $V_{DC}$ (V) (where, $V_{PP}$=1800V, f=1.5 kHz, and $V_{AC}$ is a sin wave).

By performing beta-printing of halftone of 25% on general paper having a size of A4 in indoor environments having a temperature 23° C. and a humidity of 50%, a durability experiment on 10 k (10000) sheets of monochrome is performed.

A case where an image having a desired (practically usable) printing concentration is obtained with the naked eye is denoted by o, because it is determined that the charging is good, and a case where a hole is generated in the photosensitive body by leakage and a case where periodic image spots of the charging roller are generated in an image is denoted by x, because it is determined that the charging is bad.

The charging rollers of the experimental examples of Nos. 4 to 11 were denoted by o, because it is determined that the charging is good. In the charging roller of the example of Nos. 1 to 3, since the film thickness of the conductive layer is too thin, the conductive layer is not formed on the edge of the concave portion, the core is exposed from the edge of the concave portion, and the charge leakage occurs immediately after a printing process begins, thereby obtaining a bad result. This is because the film thickness of the conductive layer is too thin, not because the concave portion is formed on the core of the present invention. Accordingly, the film thickness of the conductive layer need be set to a predetermined thickness. This film thickness may be adequately set according to circumstances.

In the charging rollers of the comparative examples of Nos. 12 to 14 in which the concave portions were not formed, since the film thickness of the conductive layer is too thin, the charge leakage was immediately after the print begins, thereby obtaining a bad result. In the charging rollers of the comparative examples of Nos. 15 to 22, periodic image spots of the charging roller were formed on the image upon 10 k sheets of print, thereby obtaining a bad result.

By this experiment, in the non-contact charging the photosensitive body 2 using the charging roller 3*a*, it is verified that, when the concave portions are formed in the both ends of the charging roller 3*a*, at least one of the above-described effects of the present invention is obtained.

In the above-described examples, the conductive layer 3*g* is formed on the outer circumferential surfaces of the insulating layers 3*j* and 3*k*. However, in the present invention, the conductive layer 3*g* need not be necessarily formed on the outer circumferential surfaces of the insulating layers 3*j* and 3*k*. Accordingly, the conductive layer 3*g* may be formed only on the concave portions of the core and the center portion of the core.

Although, in the above-described experimental examples and the comparative examples, the PI resin is used as the insulating coating material configuring the insulating member for forming the insulating layers 3*j* and 3*k*, another resin such as polyurethane (PU) resin may be used. As the insulating member, a thermal shrinkage tube (for example, thermal shrinkage tube made of PET) or a elastic rubber (for example, polyurethane (PU) resin) may be used instead of the insulating coating material.

The charging roller according to the third embodiment of the present invention is used for an image forming apparatus such as an electrophotography, an electrostatic copier, a printer, and a facsimile, and, as the charging roller for charging the photosensitive body at a predetermined charging gap in a non-contact manner, a charging roller in which a conductive layer of a charging part is formed on a metal shaft may be preferably used.

Hereinafter, a charging roller according to a fourth embodiment of the present invention will be described. The same elements as the first embodiment are denoted by the same reference numerals.

Figure 5A:
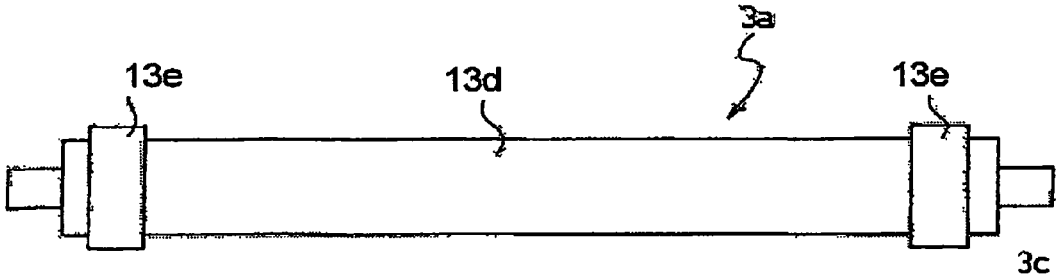
FIG. 5A is a front view of a charging roller according to a fourth embodiment of the present invention.
Figure 5B:
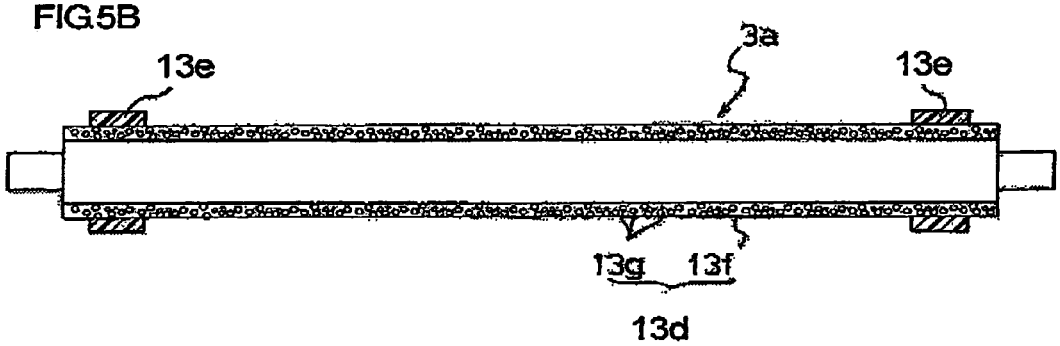
FIG. 5B is a cross-sectional view taken along an axial direction of FIG. 5A.

As shown in FIGS. 5A and 5B, the non-contact charging roller 3*a* includes a core 3*c*, a conductive resin layer 13*d* composed of a resin coating part formed on an outer circumferential surface corresponding to a charging area of the core 3*c*, and a pair of taper-shaped spacers 13*e* which is formed on the outer circumferential surfaces of the both ends of the conductive resin layer 13*d* and in contact with the photosensitive body 2 to set a predetermined gap G (shown in FIG. 1) between the conductive resin layer 13*d* and the photosensitive body 2.

The core 3*c* is, for example, composed of a metal shaft having conductivity. For example, the metal shaft obtained by coating the surface of SUM22 with Ni may be used.

The conductive resin layer 13*d* is formed on the metal shaft, for example, by the spray coating method, and has a single layer structure having a thickness of 5 to 50 μm. In the conductive resin layer, a plurality of particles 13*g* made of conductive tin oxide ($SnO_2$) is independently dispersed in binder resin 13*f* composed of resin such as polyurethane (PU) resin or polyurethane/silicon acrylic (PU/Si—Ac) mixed resin. The binder resin 13*f* is ion conductive resin having an ion conductive agent.

According to the non-contact charging roller 3*a* having the above-described configuration, since the conductive $SnO_2$ is used as the conductive agent, the chain structure is not formed in the layer, unlike the carbon black (CB) which was conventionally used as the conductive agent. Accordingly, the charge leakage is not generated at a specific position and thus stable charging can be performed.

Since the binder resin 13*f* of the conductive resin layer 13*d* is the ion conductive resin, that is, the binder resin 13*f* has the conductivity, it is possible to suppress the amount (concentration) of the conductive $SnO_2$ to a predetermined amount. To this end, even in the charging roller 3*a* in which the thin conductive resin layer 13*d* having a thickness of 5 to 50 μm is only formed on the core 3*c*, it is possible to perform stable charging for a long duration and to manufacture the charging roller 3*a* at low cost.

Next, experimental examples and comparative examples of the non-contact charging roller according to the fourth embodiment of the present invention will be described. The charging rollers of the experimental examples which belong to the fourth embodiment of the present invention and the charging rollers of the comparative examples which do not belong to the fourth embodiment of the present invention are manufactured and an experiment (hereinafter, referred to as Experiment 1) for verifying that the charging roller according to the present embodiment can obtain the above-described effect is performed using the charging rollers 3*a*.

The experimental examples and the comparative examples used for Experiment 1 are shown in Table 10.

TABLE 10

| | Charging roller | | | | | | | | |
|---|---|---|---|---|---|---|---|---|---|
| No. | Shaft diameter | Conductive agent | concentration | resin | Film thickness | Photosensitive body | velocity | Result | Note |
| 1 | φ8 | T-1 | 40 | PU | 3 | φ24 | 100 | X | leakage |
| 2 | φ10 | T-1 | 40 | PU/Si—Ac | 4 | φ30 | 250 | X | leakage |
| 3 | φ8 | T-1 | 40 | PU | 5 | φ24 | 250 | ◎ | |
| 4 | φ12 | ES | 10 | PU | 5 | φ24 | 250 | ◎ | |
| 5 | φ8 | TDL | 50 | PU/Si—Ac | 5 | φ24 | 175 | ◎ | |
| 6 | φ8 | T-1 | 60 | PU | 5 | φ24 | 100 | ◎ | |
| 7 | φ10 | T-1 | 10 | PU/Si—Ac | 10 | φ30 | 100 | ◎ | |
| 8 | φ8 | TDL | 50 | PU | 10 | φ30 | 250 | ◎ | |
| 9 | φ8 | T-1 | 60 | PU/Si—Ac | 10 | φ30 | 100 | ◎ | |
| 10 | φ12 | T-1 | 60 | PU | 5 | φ24 | 175 | ◎ | |
| 11 | φ12 | T-1 | 10 | PU | 15 | φ24 | 100 | ◎ | |
| 12 | φ8 | TDL | 50 | PU/Si—Ac | 15 | φ24 | 100 | ◎ | |
| 13 | φ10 | TDL | 60 | PU | 16 | φ40 | 175 | ◎ | |
| 14 | φ8 | ES | 15 | PU | 20 | φ40 | 100 | ◎ | |
| 15 | φ12 | T-1 | 55 | PU | 18 | φ24 | 250 | ◎ | |
| 16 | φ8 | T-1 | 60 | PU/Si—Ac | 22 | φ24 | 100 | ◎ | |
| 17 | φ10 | T-1 | 15 | PU/Si—Ac | 30 | φ24 | 100 | ◎ | |
| 18 | φ8 | T-1 | 55 | PU | 30 | φ40 | 100 | ◎ | |
| 19 | φ10 | TDL | 60 | PU | 32 | φ24 | 250 | ◎ | |
| 20 | φ10 | ES | 15 | PU | 48 | φ40 | 175 | ◎ | |
| 21 | φ8 | TDL | 55 | PU/Si—Ac | 50 | φ24 | 100 | ◎ | |
| 22 | φ12 | T-1 | 60 | PU | 51 | φ24 | 100 | X | Charging failure |
| 23 | φ12 | T-1 | 15 | PU | 52 | φ24 | 100 | X | Charging failure |
| 24 | φ8 | T-1 | 55 | PU | 51 | φ30 | 250 | X | Charging failure |
| 25 | φ8 | T-1 | 60 | PU | 55 | φ40 | 175 | X | Charging failure |
| 26 | φ8 | TDL | 60 | PU/Si—Ac | 58 | φ40 | 175 | X | Charging failure |
| 27 | φ12 | ES | 60 | PU | 58 | φ40 | 100 | X | Charging failure |
| 28 | φ8 | CB | 3 | PU | 10 | φ40 | 100 | X | leakage |
| 29 | φ10 | CB | 5 | PU | 5 | φ40 | 100 | X | leakage |
| 30 | | CB | 10 | PU/Si—Ac | 5 | φ40 | 250 | X | leakage |
| 31 | | CB | 20 | PU | 10 | φ40 | 175 | X | leakage |
| 32 | | CB | 40 | PU/Si—Ac | 20 | φ40 | 175 | X | leakage |
| 33 | | CB | 50 | PU | 40 | φ24 | 100 | X | leakage |
| 34 | | CB | 60 | PU | 70 | φ30 | 100 | X | leakage |

In Table 10, Nos. 3 to 21 denote the charging rollers of the experimental examples and Nos. 1, 2, and 22 to 34 denote the charging rollers of the comparative examples. In the charging rollers shown in Table 10, the shaft diameter is the diameter of a portion of the core 3*c* on which the conductive resin layer 13*d* is formed. The core 3*c* obtained by coating the surface of SUM22 with Ni was used. As the conductive agent, $SnO_2$ and CB were used. The conductive $SnO_2$ is made by Jemco Inc. and the detailed contents are disclosed in a homepage of Jemco Inc.

TABLE 11

| Name | Physicality | Use |
|---|---|---|
| Tin-antimony oxide Sn—Sb Oxides Trademark T-1 | 1) aspect: grayish blue powder 2) specific resistance of powder: 1-3 Ω · cm (100 kg/cm$^2$ upon applying pressure) 3) particle shape: spherical 4) primary particle diameter: 0.02 μm 5) specific gravity: 6.6 | Antistatic agent. Since a particle diameter is smaller than the wavelength of visible light, a transparent conductive film can be formed in a thin film, shape. |
| Aqueous dispersion of tin-antimony oxide Sn—Sb Oxides Dispersed Trademark TDL | 1) aspect: blue liquid (water system) 2) solid concentration: 17 wt % 3) solid average particle diameter: 100 nm 4) specific gravity: 1.17 | Antistatic agent This is aqueous dispersion of antimony oxide doped tin oxide A transparent conductive film can be formed. |
| Tin-antimony oxide coating material/dispersion Liquid Paint Sn—Sb Oxides Paint Trademark ES | 1) aspect: blue liquid 2) coating film surface resistance (measuring method of this corporation) $10^{5-9}$ Ω/□ | 1) antistatic agent 2) near infrared ray cut material Since the particle diameter of a coating material is smaller than the wavelength of visible light, a high transparent conductive film and a near infrared ray cut material can be formed. |
| Titanium oxide/tin-antimony oxide $TiO_2$/Sn—Sb Oxides Trademark W-1 | 1) aspect: light gray powder 2) specific resistance of powder: 3-10 Ω · cm (100 kg/cm$^2$ upon applying pressure) 3) particle shape: spherical 4) primary particle diameter: 0.2 μm 5) specific gravity: 4.6 | Antistatic agent In kneading with resin, this is white or colorable conductive material. |

In Table 11, all T-1, TDL, and ES are trademarks of Jemco Inc. T-1 is tin-antimony oxide, TDL is an aqueous dispersion of tin-antimony oxide, and ES is tin-antimony oxide coating material/dispersion.

In Table 10, the concentration denotes weight % (wt %) of the conductive agent added to the binder resin, and the resin is the binder resin and uses polyurethane (PU) resin or polyurethane/silicon acrylic (PU/Si—Ac) mixed resin. The conductive resin layer 13*d* is formed on the core 3*c* by the spray coating method. The film thickness of the conductive resin layer 13*d* is a value (μm) measured using a micrometer. In all the examples, 7 wt % of the ion conductive agent "YYP-12" (made by Marubishi Oil Chemical Co., Ltd.) was added to the binder resin.

The gap G of the charging roller 3*a* was set to 20 μm. The gap G was formed by adding a polyimide tape having a thickness of 20 μm on the outer circumferential surfaces of the both ends of the conductive resin layer 13*d*.

In Table 10, the photosensitive body was made of the same material as LP-9000C made by Seiko Epson Corporation. The film thickness of the photosensitive body was set to 23 μm, and the diameter of the photosensitive body was set to values (φ: mm) shown in Table 10. The velocity of Table 10 is the circumferential velocity of the photosensitive body.

An experimental apparatus of the image forming apparatus had the same configuration as that of the LP-9000C. A voltage Vc (V) applied to the charging roller 3*a* was set to $$V_C = V_{DC} + V_{AC} = -650 + (1/2)V_{PP} \cdot \sin 2\pi ft$$

obtained by overlapping an AC component $V_{AC}$ (V) with a DC component $V_{DC}$ (V) (where, $V_{PP}$=1800V, f=1.5 kHz, and $V_{AC}$ is a sin wave).

By performing beta-printing of halftone of 5% on general paper having a size of A4 in indoor environments having a temperature 23° C. and a humidity of 50%, a durability experiment on 50 k (10000) sheets of monochrome is performed. The result is shown in Table 10. When 50 k sheets of print are clear, a case where an image having a desired (practically usable) printing concentration is obtained with the naked eye is denoted by ◎, because it is determined that the charging is good, and a case where a hole is generated in the photosensitive body by leakage and a case where a desired printing concentration is not obtained with the naked eye is denoted by x, because it is determined that the charging is bad.

The charging rollers of the experimental examples of Nos. 3 to 21 were denoted by ◎, because it is determined that the charging is good. In contrast, in the charging rollers of the comparative examples of Nos. 1 and 2, the hole is formed in the photosensitive body and thus the charge leakage occurs. In the charging rollers of the comparative examples of Nos. 22 and 27, a charging failure occurs. In the charging rollers of the comparative examples of Nos. 22 and 27, the leakage or the charging failure occurs although the conductive $SnO_2$ is used in the conductive resin layer 13*d* of the charging roller 3*a*, similar to the experimental examples. Accordingly, when the experimental result is more closely examined, the film thickness of the conductive resin layer 13*d* in the comparative examples of Nos. 1 and 2 is smaller than 5 μm, the film thickness of the conductive resin layer 13*d* in the comparative examples of Nos. 22 to 27 is larger than 50 μm, and the film thickness of the conductive resin layer 13*d* in the experimental examples of Nos. 3 to 21 is in a range of 5 μm to 50 μm. Accordingly, it can be seen that, although $SnO_2$ is used in the conductive resin layer 13*d*, the charging is good when the film thickness of the conductive resin layer 13*d* is in a range of 5 μm to 50 μm, but the charging is bad when the film thickness of the conductive resin layer 13*d* is smaller than 5 μm or larger than 50 μm.

In the charging rollers of the comparative examples of Nos. 28 to 34, the CB is used in the conductive resin layer 13*d*. When the CB is used, the hole is generated in the photosensitive body and thus the leakage occurs although the film thickness of the conductive resin layer 13*d* is in a range of 5 μm to 50 μm.

By Experiment 1, in a case where the photosensitive body 2 is charged by the charging roller 3*a*, it is verified that at least one of the effects of the present embodiment is obtained when the film thickness of the conductive resin layer 13*d* is in a range of 5 μm to 50 μm and the particles 13*g* of the conductive $SnO_2$ are independently dispersed in the conductive resin layer 13*d*.

Figure 6A:
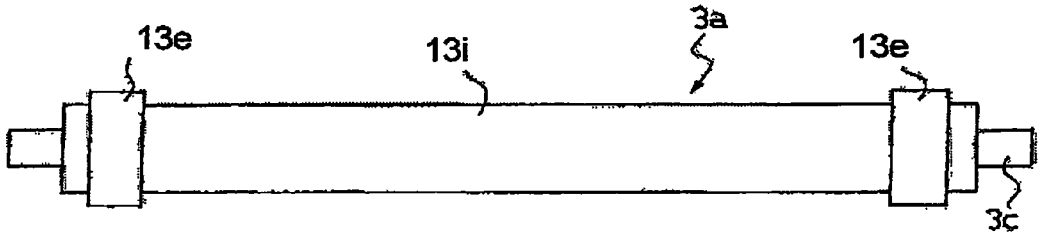
FIG. 6A is a front view of another example of the charging roller according to the fourth embodiment of the present invention.
Figure 6B:
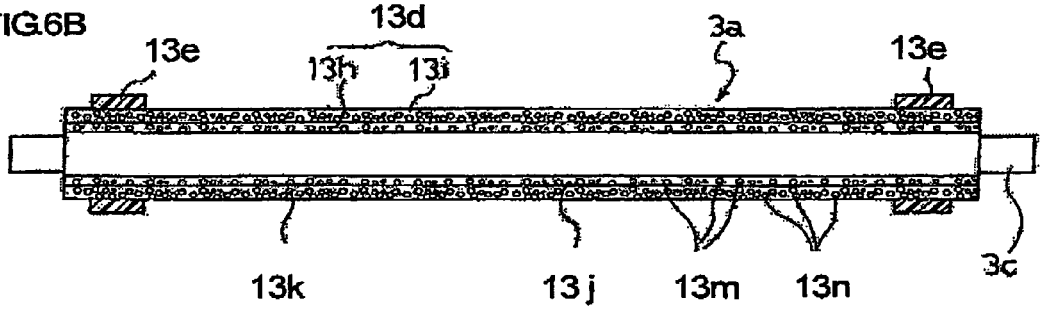
FIG. 6B is a cross-sectional view taken along an axial direction of FIG. 6A.

FIGS. 6A and 6B show another example of the charging roller according to the fourth embodiment of the present invention, where FIG. 6A is a front view thereof and FIG. 3B is a cross-sectional view taken along the axial direction thereof. The same elements as those shown in FIGS. 5A and 5B are denoted by the same reference numerals and their detailed description will be omitted.

In the charging roller 3*a* shown in FIGS. 5A and 5B, the conductive resin layer of the conductive resin layer 13*d* has a single layer structure, whereas, in the charging roller 3*a* shown in FIGS. 6A and 6B, the conductive resin layer 3*d* has a double layer structure including an inner layer 13*h* formed on the outer circumferential surface of the core 3*c* by the spray coating method and an outer layer 13*i* formed on the outer circumferential surface of the inner layer 13*h* by the spray coating method. The conductive resin layer 13*d* is not limited to the double layer structure and may be a multi-layer structure having three layers or more. In the below description, the conductive resin layer 13*d* having the double layer structure is described.

In the inner and outer layers 13*h* and 13*i* of the conductive resin layer 13*d* having the double layer structure, particles 13*m* and 13*n* made of conductive $SnO_2$ are independently dispersed in binder resins 13*j* and 13*k*, respectively, similar to the above-described example. In this case, the weight % (wt %) of the conductive $SnO_2$ added to the binder resin 13*k* of the outer layer 13*i* is set to be larger than that of the conductive $SnO_2$ added to the binder resin 13*j* of the inner layer 13*h*. When the conductive resin layer 13*d* has the multi-layer structure having three layers or more, the weight % (wt %) of the conductive $SnO_2$ added to the binder resin 13*k* is set to sequentially increase from the inner layer to the outer layer.

In the inner and outer layers 13*h* and 13*i*, the binder resins 13*j* and 13*k* are ion conductive resins having an ion conductive agent.

The film thickness of the outer layer 13*i* is set to be equal to or smaller than the film thickness of the inner layer 13*h*. When the conductive resin layer 13*d* having three layers or more, the film thicknesses of the respective layers are set such that the film thickness of the inner layer is equal to or smaller than that of the outer layer adjacent thereto.

At least a portion or all of the binder resins 13*j* and 13*k* of the respective layers 13*h* and 13*i* uses the same resin. When the conductive resin layer 13*d* has the multi-layer structure having three layers or more, at least a portion or all of adjacent inner and outer layers use the same resin.

The other configuration of the non-contact charging roller 3*a* of this example is similar to that of the example shown in FIGS. 5A and 5B.

According to the non-contact charging roller 3*a* of this example having the above-described configuration, since the conductive resin layer 13*d* has the multi-layer structure having two layers or more and the weight % of the conductive $SnO_2$ added to the binder resin 3*k* sequentially increases from the inner layer to the outer layer, the resistance of the outer layer is more reduced. Accordingly, in the entire conductive resin layer, since the amount of electrons, which can move to an uppermost conductive resin layer for the discharge, increases, the layer is hard to be destroyed due to the discharge. To this end, it is possible to perform stable charging for a long duration.

Since the conductive resin layer 13*d* has the multi-layer structure having two layers or more and at least a portion or all of the adjacent inner and outer layers is made of the same resin, the layers made of the same resin are attached to each other and adhesion between the adjacent layers can be improved. Accordingly, in the charging roller 3*a* to which a high bias voltage having a high frequency is applied, stable discharge can be performed for a long duration. To this end, it is possible to surely perform stable charging.

The other effect of the non-contact charging roller 3*a* of this example is similar to that of the example shown in FIGS. 5A and 5B.

Next, experimental examples and comparative examples of the non-contact charging roller according to the fourth embodiment of the present invention will be described. The charging rollers of the experimental examples which belong to the fourth embodiment of the present invention and the charging rollers of the comparative examples which do not belong to the fourth embodiment of the present invention are manufactured and an experiment (hereinafter, referred to as Experiment 2) for verifying that the charging roller according to the present embodiment can obtain the above-described effect is performed using the charging rollers 3*a*.

The experimental examples and the comparative examples used for Experiment 2 are shown in Table 12. The charging rollers of the experimental examples and the comparative examples used in Experiment 2 has the double layer structure including the inner layer 13*h* and the outer layer 13*i* and the same binder resin and the same conductive $SnO_2$ are used in the inner layer 13*h* and the outer layer 13*i*.

TABLE 12

| | Inner | | | | Outer | | | | | |
|---|---|---|---|---|---|---|---|---|---|---|
| No. | Conductive agent | Concentration | Resin | Film thickness | Conductive agent | Concentration | Resin | Film thickness | Result | Note |
| 1 | T-1 | 40 | PU | 5 | T-1 | 5 | PU | 3 | X | Surface layer is peeled |
| 2 | T-1 | 40 | PU | 5 | T-1 | 5 | PU | 4 | X | Surface layer is peeled |
| 3 | T-1 | 40 | PU | 5 | T-1 | 5 | PU | 5 | X | Surface layer is peeled |

TABLE 12-continued

| | Inner | | | | Outer | | | | | |
|---|---|---|---|---|---|---|---|---|---|---|
| No. | Conductive agent | Concentration | Resin | Film thickness | Conductive agent | Concentration | Resin | Film thickness | Result | Note |
| 4 | ES | 10 | PU | 5 | ES | 5 | PU | 5 | X | Surface layer is peeled |
| 5 | TDL | 50 | PU | 10 | TDL | 10 | PU | 5 | X | Surface layer is peeled |
| 6 | T-1 | 60 | PU | 10 | T-1 | 10 | PU | 5 | X | Surface layer is peeled |
| 7 | T-1 | 10 | PU | 15 | T-1 | 15 | PU | 10 | ◎ | |
| 8 | TDL | 50 | PU | 15 | TDL | 55 | PU | 10 | ◎ | |
| 9 | T-1 | 40 | PU | 5 | T-1 | 5 | PU | 3 | X | Surface layer is peeled |
| 10 | T-1 | 40 | PU | 5 | T-1 | 50 | PU | 4 | ◎ | |
| 11 | T-1 | 40 | PU | 5 | T-1 | 45 | PU | 5 | ◎ | |
| 12 | ES | 10 | PU | 5 | ES | 15 | PU | 5 | ◎ | |
| 13 | TDL | 50 | PU | 10 | TDL | 45 | PU | 5 | X | Surface layer is peeled |
| 14 | T-1 | 60 | PU | 10 | T-1 | 70 | PU | 5 | ◎ | |
| 15 | T-1 | 10 | PU | 15 | T-1 | 60 | PU | 10 | ◎ | |
| 16 | TDL | 35 | PU | 15 | TDL | 55 | PU | 10 | ◎ | |

In Table 12, Nos. 7, 8, 10 to 12, and 14 to 16 denote the charging rollers of the experimental examples and Nos. 1 to 6, 9, and 13 denote the charging rollers of the comparative examples. In the charging rollers shown in Table 12, the conductive agent is the conductive $SnO_2$ shown in Table 11 and the concentration of the conductive agent denotes weight % (wt %) of the conductive agent added to the binder resin, similar to Experiment 1. In all the examples, the binder resin is polyurethane (PU) resin. In this case, 7 wt % of the ion conductive agent "YYP-12" (made by Marubishi Oil Chemical Co., Ltd.) was added to the binder resin. The film thickness of the conductive resin layer 13*d* is measured using the same measuring method as Experiment 1 and the unit thereof is μm.

The core 3*c* obtained by coating the surface of SUM22 with Ni was used and the diameter of the shaft was ϕ8 mm in all the examples. The photosensitive body was made of the same material as LP-9000C made by Seiko Epson Corporation. The film thickness of the photosensitive body was set to 23 μm, and the diameter of the photosensitive body 2 was set to ϕ40 mm in all the examples. The circumferential velocity of the photosensitive body 2 was set to 250 mm/sec in all the examples.

The gap G of the charging roller 3*a* was set to 20 μm. The gap G was formed by adding a polyimide tape having a thickness of 20 μm on the outer circumferential surfaces of the both ends of the conductive resin layer 13*d*.

The experimental apparatus of the image forming apparatus, the applied voltage Vc (V) of the charging roller 3*a*, the indoor environments, the used transfer sheet, and the printing method are similar to those of Experiment 1. A durability experiment on 50 k sheets of monochrome is performed. The result is shown in Table 12. A case where a surface layer is peeled in the outer layer 3*i* of the conductive resin layer 13*d* before 10 k sheets of the print which can be practically provided are clear is denoted by x, because it is determined that the charging is bad and a case where 50 k sheets of print are clear is denoted by ◎, because it is determined that the charging is good.

In the charging rollers of the experimental examples of Nos. 7, 8, 10 to 12, and 14 to 16, although 5 k sheets of print are performed, good charging was performed without peeling the surface layer. In contrast, in the charging rollers of the comparative examples of Nos. 1 to 6, 9, and 13, a surface layer is peeled, the peeled conductive $SnO_2$ is attached to the photosensitive body, and the photosensitive body is scratched, thereby obtaining a bad result.

When the experimental result is more closely examined, in the comparative examples of Nos. 1 to 6, 9, and 13 in which the surface layer is peeled, the concentration, that is, weight % (wt %), of the conductive $SnO_2$ of the outer layer 13*i* of the conductive resin layer 13*d* is smaller than the concentration, that is, weight % (wt %), of the conductive $SnO_2$ of the inner layer 13*h*. In contrast, in the experimental examples of Nos. 7, 8, 10 to 12, and 14 to 16 in which the surface layer is not peeled and the good charging is performed, the concentration, that is, weight % (wt %), of the conductive $SnO_2$ of the outer layer 13*i* is larger than the concentration, that is, weight % (wt %), of the conductive $SnO_2$ of the inner layer 13*h*.

Accordingly, by Experiment 2, in a case where the photosensitive body 2 is charged by the charging roller 3*a* and the conductive resin layer 13*d* has the double layer structure, it is verified that, when the concentration, that is, weight % (wt %), of the conductive $SnO_2$ of the outer layer 13*i* is set to be larger than the concentration, that is, weight % (wt %), of the conductive $SnO_2$ of the inner layer 13*h*, good charging can be performed, that is, the above-described effect of the fourth embodiment can be obtained.

Charging rollers having the conductive resin layers 13*d* having a three-layer structure which are formed by forming third layers shown in Table 4 on the outer circumferential surfaces of the outer layers 13*i* of the charging rollers of Nos. 1 to 16 used in Experiment 2 are manufactured and an experiment (hereinafter, referred to as Experiment 3) similar to Experiment 2 is performed. In the charging rollers of the experimental examples and the comparative examples used in Experiment 3, the same binder resin and conductive $SnO_2$ are in the inner layer 13*h*, the outer layer 13*i*, and the third layer.

The result of Experiment 3 is shown in Table 13 and the evaluating method thereof is similar to that of Experiment 2.

TABLE 13

| | Third layer | | | | | |
|---|---|---|---|---|---|---|
| No. | Conductive agent | Con-centration | Resin | Film thickness | Result | Note |
| 1 | T-1 | 5 | PU | 3 | X | Surface layer is peeled |
| 2 | T-1 | 6 | PU | 4 | X | Surface layer is peeled |
| 3 | T-1 | 10 | PU | 5 | X | Surface layer is peeled |
| 4 | ES | 15 | PU | 5 | X | Surface layer is peeled |
| 5 | TDL | 5 | PU | 5 | X | Surface layer is peeled |
| 6 | T-1 | 10 | PU | 5 | X | Surface layer is peeled |
| 7 | T-1 | 20 | PU | 10 | ◎ | |
| 8 | TDL | 60 | PU | 10 | ◎ | |
| 9 | T-1 | 10 | PU | 3 | X | Surface layer is peeled |
| 10 | T-1 | 55 | PU | 4 | ◎ | |
| 11 | T-1 | 50 | PU | 5 | ◎ | |
| 12 | ES | 25 | PU | 5 | ◎ | |
| 13 | TDL | 15 | PU | 5 | X | Surface layer is peeled |
| 14 | T-1 | 75 | PU | 5 | ◎ | |
| 15 | T-1 | 65 | PU | 10 | ◎ | |
| 16 | TDL | 60 | PU | 10 | ◎ | |

In the charging rollers of the experimental examples of Nos. 7, 8, 10 to 12, and 14 to 16, although 50 k sheets of print is performed, good charging was performed without peeling the surface layer. In contrast, in the charging rollers of the comparative examples of Nos. 1 to 6, 9, and 13, before 10 k sheet of print is clear, a surface layer is peeled, the peeled conductive $SnO_2$ is attached to the photosensitive body, and the photosensitive body is scratched, thereby obtaining a bad result.

When the experimental result is more closely examined, in the comparative examples of Nos. 1 to 6, 9, and 13 in which the surface layer is peeled, the concentration, that is, weight % (wt %), of the conductive $SnO_2$ of the third layer which is an outermost layer of the conductive resin layer 13*d* is smaller than the concentration, that is, weight % (wt %), of the conductive $SnO_2$ of the inner layer 13*h* which is a first layer of an innermost layer. In contrast, in the experimental examples of Nos. 7, 8, 10 to 12, and 14 to 16 in which the surface layer is not peeled and the good charging is performed, the concentration, that is, weight % (wt %), of the conductive $SnO_2$ of the third layer is larger than the concentration, that is, weight % (wt %), of the conductive $SnO_2$ of the outer layer 13*i* which is a second layer of an intermediate layer and the concentration, that is, weight % (wt %), of the conductive $SnO_2$ of the outer layer 13*i* is larger than the concentration, that is, weight % (wt %), of the conductive $SnO_2$ of the inner layer 13*h*.

Accordingly, by Experiment 3, in a case where the photosensitive body 2 is charged by the charging roller 3*a* and the conductive resin layer 13*d* has the three-layer structure, when the concentration, that is, weight % (wt %), of the conductive $SnO_2$ of the third layer which is the outermost layer is set to be larger than the concentration, that is, weight % (wt %), of the conductive $SnO_2$ of the outer layer 13*i* which is the second layer of the intermediate layer and the concentration, that is, weight % (wt %), of the conductive $SnO_2$ of the outer layer 13*i* is set to be larger than the concentration, that is, weight % (wt %), of the conductive $SnO_2$ of the inner layer 13*h*, the surface layer is not peeled and thus good charging can be performed, that is, the above-described effect of the fourth embodiment can be obtained.

In the charging rollers having a double layer structure used in Experiment 2, the same binder resin and conductive $SnO_2$ are used in the inner layer 13*h* and the outer layer 13*i*. Charging rollers 3*a* are manufactured as the charging roller having the double layer structure such that the same binder resin is used in the inner layer 13*h* and the outer layer 13*i*, the partially same binder resin is used in the inner layer 13*h* and the outer layer 13*i*, and different binder resins are used in the inner layer 13*h* and the outer layer 13*i* and an experiment (hereinafter, referred to as Experiment 4) for verifying that the charging roller 3*a* according to the fourth embodiment can obtain at least one of the above-described effects is performed using the charging rollers 3*a*.

The charging rollers of experimental examples and comparative examples used in Experiment 4 and the result of Experiment 4 are shown Table 14. In Table 14, different conductive $SnO_2$ may be used in the experimental examples and the comparative examples, but the same conductive $SnO_2$ is used in the inner layer 13*h* and the outer layer 13*i* in all the examples.

TABLE 14

| | Inner | | | | Outer | | | | | |
|---|---|---|---|---|---|---|---|---|---|---|
| No. | Conductive agent | Con-centration | Resin | Film thickness | Conductive agent | Concentration | Resin | Film thickness | Result | Note |
| 1 | T-1 | 40 | PU | 5 | T-1 | 45 | PU | 3 | ◎ | 50k clear |
| 2 | T-1 | 40 | PU | 5 | T-1 | 45 | PU | 4 | ◎ | 50k clear |
| 3 | T-1 | 40 | Si | 5 | T-1 | 50 | Si | 5 | ◎ | 50k clear |
| 4 | ES | 10 | PU/Si—Ac | 5 | ES | 20 | PU/Si—Ac | 5 | ◎ | 50k clear |
| 5 | TDL | 50 | PU | 10 | TDL | 55 | PU/Si—Ac | 5 | ◎ | 50k clear |
| 6 | T-1 | 30 | PU/Si—Ac | 10 | T-1 | 60 | PU | 5 | ◎ | 50k clear |

TABLE 14-continued

| | Inner | | | | Outer | | | | | |
|---|---|---|---|---|---|---|---|---|---|---|
| No. | Conductive agent | Concentration | Resin | Film thickness | Conductive agent | Concentration | Resin | Film thickness | Result | Note |
| 7 | T-1 | 10 | Ac | 15 | T-1 | 15 | Ac | 10 | ◎ | 50k clear |
| 8 | TDL | 50 | PU | 15 | TDL | 55 | Si—Ac | 10 | X | 3k clear |
| 9 | T-1 | 40 | PU | 5 | T-1 | 45 | Si—Ac | 3 | X | 3k clear |
| 10 | T-1 | 40 | PU | 5 | T-1 | 50 | Si | 4 | X | 2k clear |
| 11 | T-1 | 40 | PU/Si—Ac | 5 | T-1 | 45 | PU | 5 | ◎ | 50k clear |
| 12 | ES | 10 | PU | 5 | ES | 15 | Ac | 5 | X | 2k clear |

In Table 14, Nos. 1 to 7 and 11 denote the charging rollers of the experimental examples and Nos. 8 to 10 and 12 denote the charging rollers of the comparative examples. In the charging rollers shown in Table 14, the conductive agent is the conductive $SnO_2$ shown in Table 12 and the concentration of the conductive agent denotes weight % (wt %) of the conductive agent added to the binder resin, similar to Experiment 1. The binder resin is polyurethane (PU) resin or polyurethane/silicon acrylic (PU/Si—Ac) mixed resin.

In this case, 7 wt % of the ion conductive agent "YYP-12" (made by Marubishi-Oil Chemical Co., Ltd.) was added to the binder resin. The other configuration of the charging roller 3*a* except the conductive resin layer 13*d*, the units of the values in Table 14, the experimental apparatus including the photosensitive body, and the experimental method except 10 k sheets of print are similar to Experiment 2.

A case where a surface layer is peeled before 10 k sheets of the print are clear is denoted by x, because it is determined that the charging is bad and a case where 50 k sheets of print are clear is denoted by ◎, because it is determined that the charging is good.

In the charging rollers of the experimental examples of Nos. 1 to 7 and 11, although 5 k sheets of print are performed, good charging was performed without peeling the surface layer. In contrast, in the charging rollers of the comparative examples of Nos. 8 and 9, a surface layer is peeled after 3 k sheets of print is clear and, in the charging rollers of the comparative examples of Nos. 10 and 12, a surface layer is peeled after 2 k sheets of print is clear, the peeled conductive $SnO_2$ is attached to the photosensitive body, and the photosensitive body is scratched, thereby obtaining a bad result.

When the experimental result is more closely examined, in the comparative examples of Nos. 8 to 10 and 12, in which the surface layer is peeled, the different binder resins are used in the respective layers, whereas, in the experimental examples of Nos. 1 to 7 and 11, in which the surface layer is not peeled and the good charging is performed, the same binder resin or the partially same binder resin is used in the respective layers.

Accordingly, by Experiment 4, in a case where the photosensitive body 2 is charged by the charging roller 3*a* and the conductive resin layer 13*d* has the multi-layer structure, it is verified that, although 10 k sheets of print are clear, the surface layer is not peeled and good charging can be performed, that is, the above-described effect of the fourth embodiment can be obtained.

The binder resin used in Experiments 1 to 4 is the ion conductive resin. Accordingly, it is examined whether the above-described effect is obtained depending on whether the binder resin is the ion conductive resin. Experiments (hereinafter, referred to as Experiments 5 and 6, respectively) in which the binder resin is not the ion conductive resin is performed, which are similar to Experiments 1 and 4.

First, Experiment 5 corresponding to Experiment 1 will be described. Experimental examples and comparative examples used in Experiment 5 and the experimental result are shown in Table 15. In this case, a case where an image having a print concentration which can be practically provided is obtained although 10 k sheets of print are performed is denoted by o, because it is determined that the charging is good.

TABLE 15

| | Charging roller | | | | | | | | |
|---|---|---|---|---|---|---|---|---|---|
| No. | Shaft diameter | Conductive agent | Concentration | Resin | Film thickness | Photosensitive body | Velocity | Result | Note |
| 1 | ϕ8 | T-1 | 40 | PU | 5 | ϕ24 | 250 | ○ | 10k clear |
| 2 | ϕ12 | ES | 10 | PU | 5 | ϕ24 | 250 | ○ | 11k clear |
| 3 | ϕ8 | TDL | 50 | PU/Si—Ac | 5 | ϕ24 | 175 | ○ | 10.5k clear |
| 4 | ϕ8 | T-1 | 60 | PU | 5 | ϕ24 | 100 | ○ | 10.2k clear |

In Table 15, Nos. 1 to 4 denote the charging rollers of the experimental examples of the fourth embodiment of the present invention and correspond to Nos. 3 to 6 shown in Table 10 of Experiment 1. In the experimental examples of Nos. 1 to 4 in Experiment 5, the ion conductive agent is not added to the polyurethane (PU) resin or the polyurethane/silicon acrylic (PU/Si—Ac) mixed resin, which is the binder resin, and the binder resin is not the ion conductive resin. The other configuration of the charging roller 3*a* except the binder resin, the units of the values in Table 15, the experimental apparatus including the photosensitive body, and the experimental method are similar to Experiment 1.

In the experimental examples of Nos. 1 to 4 in Experiment 5, an image having a print concentration which can be practically provided was obtained when 10 k sheets of print are clear, and, in the experimental examples of Nos. 3 to 6 in Experiment 1, good charging was performed.

Accordingly, by Experiment 5, in a case where the photosensitive body 2 is charged by the charging roller 3*a* and the binder resin of the conductive resin layer 13*d* is not the ion conductive resin (ion conductive agent is not added), it can be seen that 10 k sheets of print can be clear, an image having a print concentration which can be practically provided can be obtained, and good charging can be performed. However, when the binder resin is the ion conductive resin (ion conductive agent is added), it can be seen that 50 k sheets of print can be clear and thus good charging can be stably performed for a longer duration. To this end, it is verified that the binder resin is preferably the ion conductive resin and the effect verified in Experiment 1 can be obtained.

Next, Experiment 6 corresponding to Experiment 4 will be described. Experimental examples and comparative examples used in Experiment 6 and the experimental result are shown in Table 16. A case where an image having a print concentration which can be practically provided is obtained although 10 k sheets of print are performed is denoted by o, because it is determined that the charging is good.

print concentration which can be practically provided can be obtained, and good charging can be performed. However, when the binder resin is the ion conductive resin (ion conductive agent is added), it can be seen that 50 k sheets of print can be clear and thus good charging can be stably performed for a longer duration. To this end, it is verified that the binder resin is preferably the ion conductive resin and the effect verified in Experiment 4 can be obtained.

The charging roller according to the fourth embodiment of the present invention is used for an image forming apparatus such as an electrophotography, an electrostatic copier, a printer, and a facsimile, and, as the charging roller for charging the photosensitive body at a predetermined charging gap in a non-contact manner, a charging roller in which a conductive resin layer is formed on a metal shaft may be preferably used.

Hereinafter, a fifth embodiment of the present invention will be described with reference to the attached drawings.

Figure 7:
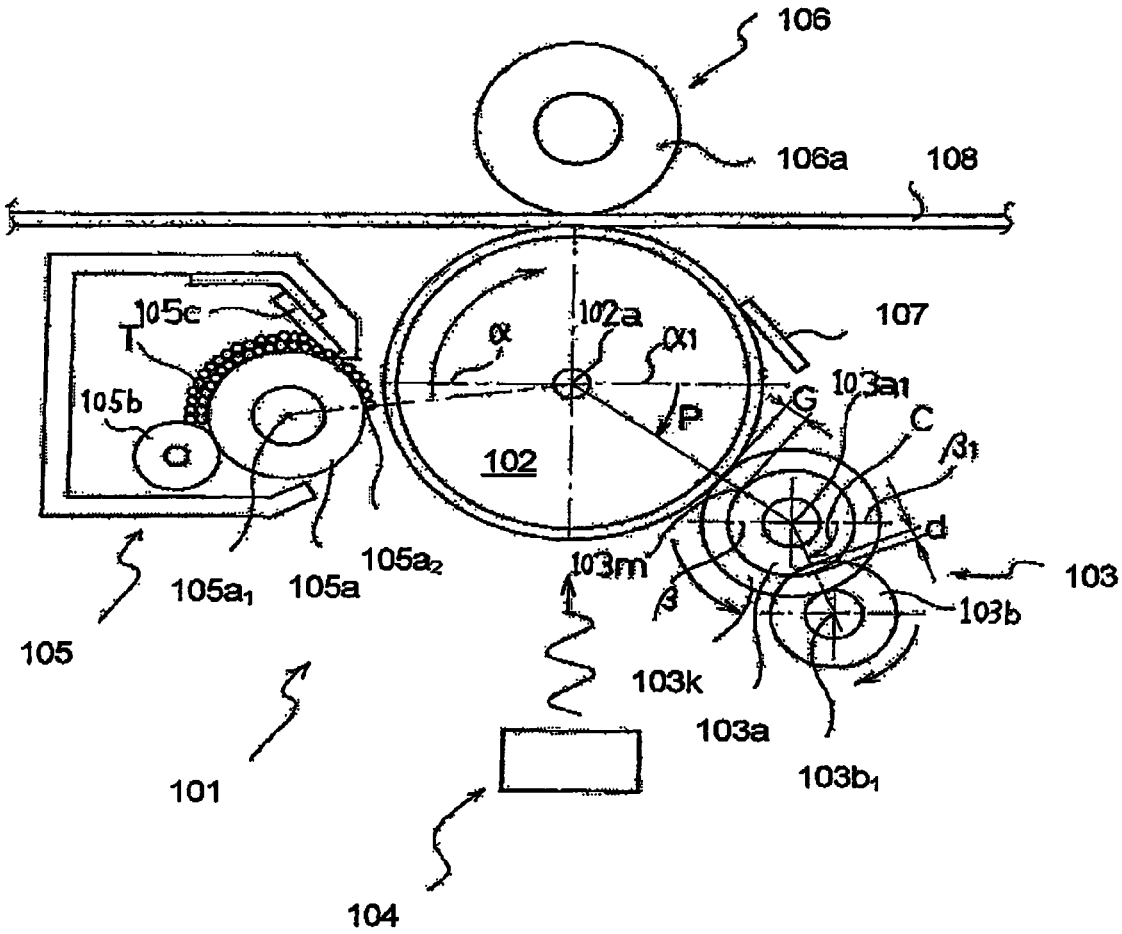
FIG. 7 is a view schematically showing an image forming apparatus according to a fifth embodiment of the present invention.

FIG. 7 is a view schematically showing an example of an image forming apparatus of the fifth embodiment of the present invention.

As shown in FIG. 7, an image forming apparatus 101 includes a photosensitive body 102 which is an image carrier on which an electrostatic latent image and a toner image are formed. The image forming apparatus 101 further includes a non-contact charging device 103, an optical record device 104, and a development device 105, a transfer device 106, and a cleaning device 107 in the vicinity of the photosensitive

TABLE 16

| | Inner | | | | Outer | | | | | |
|---|---|---|---|---|---|---|---|---|---|---|
| No. | Conductive agent | Concentration | Resin | Film thickness | Conductive agent | Concentration | Resin | Film thickness | Result | Note |
| 1 | T-1 | 40 | PU | 5 | T-1 | 45 | PU | 3 | ○ | 10.1k clear |
| 2 | T-1 | 40 | PU | 5 | T-1 | 45 | PU | 4 | ○ | 10k clear |
| 3 | T-1 | 40 | Si | 5 | T-1 | 50 | Si | 5 | ○ | 10.5k clear |
| 4 | ES | 10 | PU/Si—Ac | 5 | ES | 20 | PU/Si—Ac | 5 | ○ | 10.5k clear |

In Table 16, Nos. 1 to 4 denote the charging rollers of the experimental examples of the fourth embodiment of the present invention and correspond to Nos. 1 to 4 shown in Table 14 of Experiment 4. In the experimental examples of Nos. 1 to 4 in Experiment 6, the ion conductive agent is not added to the polyurethane (PU) resin or the polyurethane/silicon acrylic (PU/Si—Ac) mixed resin, which is the binder resin, in the inner layer 13*h* and the outer layer 13*i* and the binder resin is not the ion conductive resin. The other configuration of the charging roller 3*a* except the binder resin, the units of the values in Table 16, the experimental apparatus including the photosensitive body, and the experimental method are similar to Experiment 4.

In the experimental examples of Nos. 1 to 4 in Experiment 6, an image having a print concentration which can be practically provided was obtained when 10 k sheets of print are clear, and, in the experimental examples of Nos. 1 to 4 in Experiment 4, good charging was performed.

Accordingly, by Experiment 6, in a case where the photosensitive body 2 is charged by the charging roller 3*a* and the binder resin of the conductive resin layer 13*d* is not the ion conductive resin (ion conductive agent is not added), it can be seen that 10 k sheets of print can be clear, an image having a body 102 in that order from an upstream side to a downstream side in a rotation direction (clockwise direction in FIG. 7) of the photosensitive body 102.

The charging device 103 includes a non-contact charging roller 103*a* and a cleaning member 103*b* which is in contact with the charging roller 103, with respect to the photosensitive body 102. The charging device 103 further includes. A rotation center $\mathbf{103}a_1$ of the charging roller 103*a* is lower than a horizontal line a passing through a rotation center of the photosensitive body 102 and located at a downstream side in the rotation direction of the photosensitive body 102 than the horizontal line α. In this case, the rotation center $\mathbf{103}a_1$ of the charging roller 103*a* is located at an upstream side in the rotation direction of the photosensitive body 102 just below the rotation center 102*a* of the photosensitive body 102.

That is, the rotation center $\mathbf{103}a_1$ of the charging roller 103*a* is set to a position of an angle P(°) from a horizontal line portion $\alpha_1$, in which the rotation direction of the photosensitive body 102 is downward, of the horizontal line α in the rotation direction of the photosensitive body 102. The rotation center $\mathbf{103}a_1$ of the charging roller 103*a* is not set to a position in which the angle P is equal to or larger than 90°. This is because, when the rotation center $\mathbf{103}a_1$ of the charging roller 103*a* is set to a position in which the angle P is equal to or larger than 90°, a space between the development device 105 and the charging roller 103*a* becomes narrower and thus the optical record device 104 is hard to be mounted and the optical record device 104 is located just below or substantially just below the development roller 105*a* and thus the extraneous material such that the toner dropping from the development roller 105*a* may contaminate the optical record device 104. Accordingly, the charging roller 103*a* according to the present intention is set in a range of 0°<angle P<90°.

The rotation center $\mathbf{103}b_1$ of the cleaning member 103*b* is located below a horizontal line β passing through the rotation center $\mathbf{103}a_1$ of the charging roller 103*a* and located at an upstream side of the rotation direction of the charging roller than the horizontal line β. That is, the rotation center $\mathbf{103}b_1$ of the cleaning member 103*b* is set to a position of an angle C(°) from a horizontal line portion $\beta_1$, in which the rotation direction of the charging roller 103*a* is upward, of the horizontal line β passing through the rotation center $\mathbf{103}b_1$ of the cleaning member 103*b* in the opposite direction of the rotation direction of the charging roller 103*a*. In addition, the rotation center $\mathbf{103}b_1$ of the cleaning member 103*b* need be formed such that the photosensitive body 102 and the optical record device 104 do not interfere with each other.

Both the charging roller 103*a* and the cleaning member 103*b* are located below the photosensitive body 102 in the gravity direction and the cleaning member 103*b* is located below the charging roller 103*a* in the gravity direction.

The position angle P(°) of the rotation center $\mathbf{103}a_1$ of the charging roller 103*a* and the position angle C(°) of the rotation center $\mathbf{103}b_1$ of the cleaning member 103*b* are set to be different from each other. That is, a straight line for connecting the rotation center $\mathbf{103}a_1$ of the charging roller 103*a* and the rotation center 102*a* of the photosensitive body 102 and a straight line for connecting the rotation center $\mathbf{103}a_1$ of the charging roller 103*a* and the rotation center $\mathbf{103}b_1$ of the cleaning member 103*b* intersect each other.

The charging roller 103*a* rotates according to the rotation of the photosensitive body 102 in a state that the insulating layers 103*j* and 103*k* for setting the charging gap G are in contact with the photosensitive body 102. Accordingly, the rotation direction of the charging roller 103*a* is opposite (a counterclockwise direction in FIG. 7) to the rotation direction of the photosensitive body 102. In addition, the cleaning member 103*b* is in contact with the charging roller 103*a* and rotates according to the rotation of the charging roller 103*a*. Accordingly, the rotation direction of the cleaning member 103*b* is opposite (a clockwise direction in FIG. 7 or the same direction as the photosensitive body 102) to the rotation direction of the charging roller 103*a*.

In this case, in the present embodiment, the rotation direction of the cleaning member 107 is defined as a forward direction. In this example, the forward direction of the charging roller 103*a* is the counterclockwise direction and the forward direction of the cleaning member 103*b* is the clockwise direction. The circumferential velocity of the charging roller 103*a* and the circumferential velocity of the photosensitive body 102 are equal or substantially equal to each other (that is, a circumferential velocity ratio is 1 or about 1) and the circumferential velocity of the cleaning member 103*b* and the circumferential velocity of the charging roller 103*a* are equal or substantially equal to each other (that is, a circumferential velocity ratio is 1 or about 1).

The photosensitive body 102 is uniformly charged by the charging roller 103*a*, and the charging roller 103*a* is cleaned by the cleaning member 103*b* such that an extraneous material attached to the charging roller 103*a*, such as toner or dust, is removed.

Figure 8A:
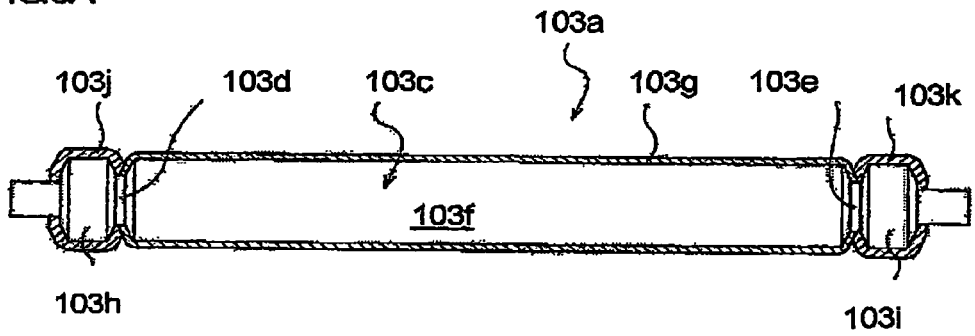
FIG. 8A is a cross-sectional view taken along an axial direction of a charging roller used in the image forming apparatus according to the fifth embodiment of the present invention.

As shown in FIG. 8A, the non-contact charging roller 103*a* includes a core 103*c*. The core 103*c* is, for example, composed of a conductive shaft such as a metal shaft. For example, a conductive shaft obtained by coating the surface of SUM22 with Ni may be used.

Annular concave portions 103*d* and 103*e* are formed in the outer circumferential surfaces of the both ends of the core 103*c*. A conductive layer 103*g* is formed by coating the outer circumferential surface of a center portion 103*f* of the core 103*c* between the concave portions 103*d* and 103*e* with a conductive coating material using a spray coating method. In this case, the conductive coating material enters into the concave portions 103*d* and 103*e* to partially cover the concave portions 103*d* and 103*e* of the core 103*c*. The conductive layer 103*g* configures a charging part for charging the photosensitive body 102 at a predetermined charging gap G in a non-contact manner.

In addition, insulating layers 103*j* and 103*k* are formed by coating the outer circumferential surfaces of the both ends 103*h* and 103*i* of the core 103*c* outer than the concave portions 103*d* and 103*e* with an insulating coating material, for example, using a spray coating method. In this case, the insulating coating material enters into the concave portions 103*d* and 103*e* to partially cover the concave portions 103*d* and 103*e* of the core 103*c* and to cover the both ends of the core 103*c*. The outer diameters of the insulating layers 103*j* and 103*k* are set to be equal to each other. The film thickness of the insulating layers 103*j* and 103*k* is set to be larger than that of the conductive layer 103*g*. Accordingly, the insulating layers 103*j* and 103*k* are in contact with the photosensitive body 102 to configure a gap part for setting the predetermined charging gap G between the conductive layer 103*g* and the photosensitive body 102 based on a film thickness difference therebetween. The insulating layers 103*j* and 103*k* configuring the gap part are formed on the outer circumferential surface of the core 103*c*.

Figure 8B:
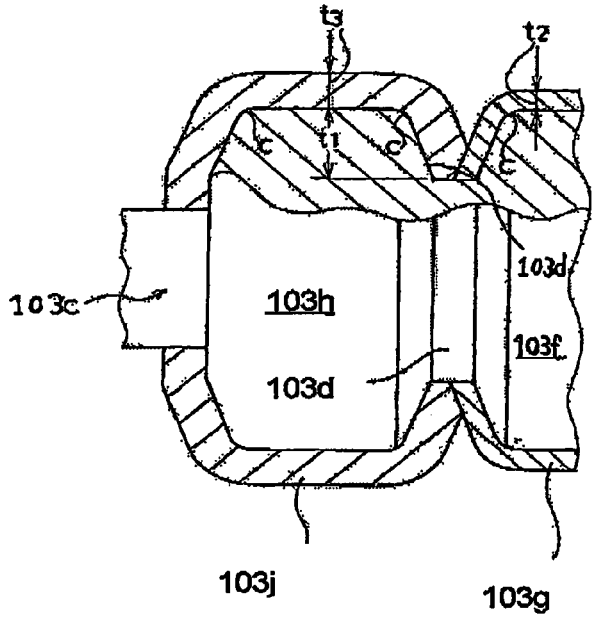
FIG. 8B is a partial enlarged cross-sectional view of FIG. 8A.

As shown in FIG. 8B, the depth $t_1$ of the concave portion 103*d* is set to be larger than a sum of the thickness $t_2$ of the conductive layer 103*g* and the film thickness $t_3$ of the insulating layer 103*j* ($t_1>t_2+t_3$). Accordingly, the depth $t_1$ of the concave portion 103*d* is set to be larger than any one of the film thickness $t_2$ of the conductive layer 103*g* and the film thickness $t_3$ of the insulating layer 103*j* ($t_1>t_2$, $t_1>t_3$, and $t_3>t_2$).

In addition, an edge of the concave portion 103*d* of the core 103*c* is chamfered (C-cut) c. Edges of the end 103*h* of the core 103*c* are also chamfered (C-cut) c. The chamfer c is generally called an R part and defined as a rounded edge obtained by cutting the edge in a curved shape. The chamfer c may be formed by cutting the edge in a flat slope surface.

Although FIG. 8B shows only the concave portion 103*d* and the insulating layer 103*j* of one end 103*h*, the concave portion 103*e* and the insulating layer 103*k* of the other end 103*i* are formed similar to the concave portion 103*d* and the insulating layer 103*j* of the end 103*h*.

The conductive layer 103*g* and the insulating layer 103*j* and 103*k* may be formed on the core 103*c* by forming the conductive layer 103*g* and then forming the insulating layers 103*j* and 3*k*, and vice versa.

The cleaning member 103*b* may be a known cleaning roller such as an insulating sponge, a conductive sponge, an insulating brush, or a conductive brush. In this case, the inroad depth d between the cleaning member 103*b* and the charging roller 103*a* due to the contact is set to a predetermined value (for example, 0.5 mm) of the image forming apparatus 101.

The optical record device 104 is located below the horizontal line α and records an electrostatic latent image onto the photosensitive body 102, for example, using laser light. The development device 105 includes a development roller 105*a*, a toner feed roller 105*b*, and a toner layer thickness regulating member 105*c*. A rotation center 105$a_1$ of the development roller 105*a* is located below the horizontal line a in the image forming apparatus 101 of this example. The location of the rotation center 105$a_1$ of the development roller 105*a* is not limited to this.

The toner T which is a development agent is fed onto the development roller 105*a* by the toner feed roller 105*b* and the thickness of the toner T on the development roller 105*a* is regulated by the toner layer thickness regulating member 105*c*. Then, the toner T is carried to the photosensitive body 102 and the electrostatic latent image on the photosensitive body 102 is developed by the carried toner T such that a toner image is formed on the photosensitive body 102.

A portion 3*m* of the charging roller 103*a* closest to the photosensitive body 102 is located below a portion 105$a_2$ of the development roller 105*a* closest to the photosensitive body 102 (outer circumferential portion of the development roller 105 which a straight line for connecting the rotation center 105$a_1$ of the development roller 105*a* and a rotation center 102*a* of the photosensitive body 102 intersects) in a gravity direction.

In the image forming apparatus 101 of this example, the image carrier 102, the charging device 103, and the optical record device 104 are integrally configured as an image carrier cartridge, similar to the image forming apparatus disclosed in JPA'758. Alternatively, the image carrier 102, the charging device 103, the optical record device 104, and the development 105 may be integrally configured as the image forming cartridge.

The transfer device 106 has a transfer roller 106*a*, which transfers the toner image on the photosensitive body 102 onto a transfer medium 108 such as a transfer sheet or an intermediate transfer medium. When the toner image is transferred onto the transfer sheet which is the transfer medium 108, the toner image on the transfer sheet is fixed by a fixing device (not shown), thereby forming and an image on the transfer sheet. When the toner image is transferred onto the intermediate transfer medium which is the transfer medium 108, the toner image on the intermediate transfer medium is transferred onto a transfer sheet again and the toner image on the transfer sheet is fixed by a fixing device (not shown), thereby forming an image on the transfer sheet.

The cleaning device 107, for example, includes a cleaning member 107*a* such as a cleaning blade. The photosensitive body 102 is cleaned by the cleaning member 107*a* and remaining toner on the photosensitive body 102 is removed and collected.

According to the image forming apparatus 101 of this example, since the cleaning member 103*b* is located below the horizontal line passing through the rotation center 103$a_1$ of the charging roller 103*a*, that is, the cleaning member 103*b* is located below the charging roller 103 in the gravity direction, it is possible to naturally drop scraped extraneous material when the cleaning member 103*b* scrapes the extraneous material on the charging roller 103*a* such as the toner. To this end, the extraneous material such as the scraped toner does not advance to the optical record device 104. Accordingly, the extraneous material is hard to be attached to the optical record device 104 and thus an image can be stably formed for a long direction. Particularly, since the charging roller 103*a* charges the photosensitive body 102 in the non-contact manner such that the extraneous material such as the toner is suppressed from floating from the photosensitive body 102 upon the non-contact charging, it is possible to efficiently suppress the contamination of the optical record device 104.

Since the photosensitive body 102 and the charging roller 103*a* rotate in opposite directions, the cleaning member 103*b* and the charging roller 103*a* rotate in opposite directions, and the optical record device 104 is disposed at the downstream side in the rotation direction of the photosensitive body 102 than the charging roller 103*a*, the extraneous material such as the toner scraped from the charging roller 103*a* by the cleaning member 103*b* can advance to the opposite side of the optical record device 104. Since the cleaning member 103*b* functions as a wall, the extraneous material such as the scraped toner can be suppressed from advancing to the optical record device 104. To this end, the extraneous material is hard to be attached to the optical record device 104 and thus the image can be stably formed for a long duration.

Since the circumferential velocity of the charging roller 103*a* and the circumferential velocity of the photosensitive body are set to be equal or substantially equal to each other (circumferential velocity ratio is 1 or about 1), the extraneous material such as the toner is hard to float and thus the extraneous material can be efficiently suppressed from being attached to the optical record device 104. In addition, since the circumferential velocity of the cleaning member 103*b* and the circumferential velocity of the charging roller 103*a* are set to be equal or substantially equal to each other (circumferential velocity ratio is 1 or about 1), the extraneous material such as the toner is hard to float and thus the extraneous material can be efficiently suppressed from being attached to the optical record device 104

Since the straight line for connecting the rotation center 103$a_1$ of the charging roller 103*a* and the rotation center 102*a* of the photosensitive body 102 and the straight line for connecting the rotation center 103$a_1$ of the charging roller 103*a* and the rotation center 103$b_1$ of the cleaning member 103*b* intersect each other, the distance between the charging roller 103*a* and the photosensitive body 102 can be suppressed from being influenced by a contact force of the cleaning member 103*b* against the charging roller 103*a*.

Accordingly, although the cleaning member 103*b* is closely in contact with the charging roller 103, the charging gap G can be stably set over the entire charging area for a long duration.

Next, experimental examples and comparative examples of the image forming apparatus according to the fifth embodiment will be described. The image forming apparatus of the experimental examples which belong to the fifth embodiment and the image forming apparatus of the comparative examples which do not belong to the fifth embodiment are manufactured and an experiment for verifying that the image forming apparatus according to the fifth embodiment can obtain the above-described effect is performed using these image forming apparatuses.

The charging roller and the cleaning member of the image forming apparatus of the experimental examples and the comparative examples used in the experiment and the experimental result are shown in Table 17.

TABLE 17

| No. | Charging roller Diameter | Cleaning Position | Cleaning Kind | Cleaning Position | Cleaning Rotation direction | Diameter of photosensitive body | Result | Note |
|---|---|---|---|---|---|---|---|---|
| 1 | 8 | P45°° | Insulating sponge | C90° | Forward | 24 | ○ | |
| 2 | 8 | P45° | Conductive brush | C90° | Forward | 40 | ○ | |
| 3 | 10 | P30° | Insulating brush | C90° | Forward | 24 | ○ | |
| 4 | 8 | P30° | Conductive sponge | C90° | Forward | 40 | ○ | |
| 5 | 8 | P90° (just below) | Insulating sponge | C90° | Forward | 24 | X | Optical record contamination (100NG) |
| 6 | 10 | P45° | Insulating sponge | C90° | Forward | 24 | ○ | |
| 7 | 12 | P45° | Conductive brush | C90° | Forward | 40 | ○ | |
| 8 | 10 | P30° | Insulating brush | C90° | Forward | 24 | ○ | |
| 9 | 12 | P30° | Conductive sponge | C90° | Forward | 30 | ○ | |
| 10 | 10 | P90° (just below) | Insulating sponge | C100° | Forward | 24 | X | Optical record contamination (90NG) |
| 11 | 12 | P25° | Insulating sponge | C10° | Forward | 24 | ○ | |
| 12 | 12 | P25° | Conductive brush | C170° | Forward | 40 | ○ | |
| 13 | 12 | P25° | Conductive brush | C270° | Forward | 24 | X | Optical record contamination (500NG) |
| 14 | 12 | P30° | Conductive sponge | C90° | Forward | 40 | ○ | |
| 15 | 12 | P120° | Conductive sponge | C90° | Forward | 40 | X | Optical record contamination (50NG) |
| 16 | 10 | P140° | Conductive brush | C25° | Forward | 40 | X | Optical record contamination (30NG) |
| 17 | 8 | P45° | Conductive brush | C90° | Backward | 40 | X | Optical record contamination (500NG) |
| 18 | 10 | P30° | Insulating brush | C0° | Forward | 24 | X | Optical record contamination (800NG) |
| 19 | 10 | P45° | Insulating sponge | C135° | Forward | 24 | ○ | |
| 20 | 10 | P45° | Insulating sponge | C135° | Backward | 24 | X | Optical record contamination (500NG) |
| 21 | 12 | P45° | Conductive brush | C135° | Backward | 24 | X | Optical record contamination (500NG) |
| 22 | 12 | P45° | Conductive brush | C300° | Forward | 40 | X | Optical record contamination (800NG) |
| 23 | 10 | P30° | Insulating brush | C350° | Forward | 24 | X | Optical record contamination (800NG) |

In Table 17, Nos. 1 to 4, 6 to 9, 11, 12, 14, and 19 denote the experimental examples of the fifth embodiment and Nos. 5, 10, 13, 15 to 18, and 20 to 23 denote the comparative examples of the fifth embodiment. The charging rollers are shown in FIGS. 8A and 8B and the unit of the shaft diameter of the core 103*c* (diameter ϕ of a portion of the core 103*c* on which the conductive layer 103*g* is formed) is mm.

The film thickness of the conductive layer 103*g* is 15 μm and the film thickness of the insulating layers 103*j* and 103*k*, that is, the charging gap G, is 20 μm. P45° in Table 17 represents that an angle P is 45° and C90° represents that an angle C is 90°.

The shaft diameter of the core of each charging roller (diameter of a portion of the core 103*c* on which the conductive layers 103*g* is formed) of each example was ϕ8 mm. The core 103*c* obtained by coating the surface of SUM22 with Ni was used. The depth of concave portion formed in the core was set to 100 μm.

The conductive coating material and the insulating coating material shown in Table 18 were used.

TABLE 18

| | |
|---|---|
| Conductive material (charging part) | Conductive $SnO_2$ 19%<br>PU 18%<br>Ion conductive material ⌈YYP-12⌋ 3%<br>Water 60% |
| Insulating material (gap part) | PU 100% |

As shown in Table 16, the conductive coating material is coating liquid including 19 wt % of conductive $SnO_2$, 18 wt % of polyurethane (PU), 3 wt % of an ion conductive material, and 60 wt % of water. The conductive $SnO_2$ is made by Jemco Inc. shown in Table 19 and the detailed contents are disclosed in a homepage of Jemco Inc.

TABLE 19

| Name | Physicality | Use |
|---|---|---|
| Tin-antimony oxide Sn—Sb Oxides Trademark T-1 | 1) aspect: grayish blue powder<br>2) specific resistance of powder: 1-3 Ω · cm (100 kg/cm$^2$ upon applying pressure)<br>3) particle shape: spherical<br>4) primary particle diameter: 0.02 μm<br>5) specific gravity: 6.6 | Antistatic agent Since a particle diameter is smaller than the wavelength of visible light, a transparent conductive film can be formed in a thin film shape. |
| Aqueous dispersion of tin-antimony oxide Sn—Sb Oxides Dispersed Trademark TDL | 1) aspect: blue liquid (water system)<br>2) solid concentration: 17 wt %<br>3) solid average particle diameter: 100 nm<br>4) specific gravity: 1.17 | Antistatic agent This is aqueous dispersion of antimony oxide doped tin oxide A transparent conductive film can be formed. |

TABLE 19-continued

| Name | Physicality | Use |
|---|---|---|
| Tin-antimony oxide coating material/dispersion Liquid Paint Sn—Sb Oxides Paint Trademark ES | 1) aspect: blue liquid<br>2) coating film surface resistance (measuring method of this corporation) $10^{5-9}$ Ω/□ | 1) antistatic agent<br>2) near infrared ray cut material Since the particle diameter of a coating material is smaller than the wavelength of visible light, a high transparent conductive film and a near infrared ray cut material can be formed. |
| Titanium oxide/tin-antimony oxide $TiO_2$/Sn—Sb Oxides Trademark W-1 | 1) aspect: light gray powder<br>2) specific resistance of powder: 3-10 Ω · cm (100 kg/cm$^2$ upon applying pressure)<br>3) particle shape: spherical<br>4) primary particle diameter: 0.2 μm<br>5) specific gravity: 4.6 | Antistatic agent In kneading with resin, this is white or colorable conductive material. |

The conductive $SnO_2$ used in the experimental examples and the comparative examples is trademark "T-1" made by Jemco, Inc, "T-1" is tin-antimony oxide. In the present invention, the other conductive $SnO_2$ may be used.

The ion conductive material is to apply conductivity to the conductive coating material. The ion conductive material used in the experimental examples and the comparative examples is "YYP-12" (made by Marubishi Oil Chemical Co., Ltd.).

The insulating coating material configuring the gap part is 100 wt % of polyurethane (PU) resin.

In the method of manufacturing the charging rollers of the respective examples, the charging rollers of Nos. 1 to 3, 10 to 13, and 16 were manufactured by coating the both ends of the core with the insulating coating material using the spray coating method to form the insulating layer and coating the center portion of the core with the conductive coating material using the spray coating method to form the conductive layer.

The cleaning member was the cleaning roller composed of any one of the insulating sponge, the conductive sponge, the insulating brush, and the conductive brush. The diameter of the cleaning roller was ϕ 12±0.2 mm. The material of the insulating sponge is polyurethane, the material of the insulating brush is conductive polyurethane, the material of insulating brush is polyester, and the material of the conductive brush is conductive polyester.

The photosensitive body was made of the same material as LP-9000C made by Seiko Epson Corporation. The film thickness of the photosensitive body was set to 23 μm, the unit of the diameter ϕ of the photosensitive body in Table 1 was mm, and the circumferential velocity of the photosensitive body was set to 250 mm/sec.

An experimental apparatus of the image forming apparatus had the same configuration as that of the LP-9000C. A voltage Vc (V) applied to the charging roller 103*a* was set to $$V_C = V_{DC} + V_{AC} = -650 + (1/2) V_{PP} \cdot \sin 2\pi ft$$

obtained by overlapping an AC component $V_{AC}$ (V) with a DC component $V_{DC}$ (V) (where, $V_{PP}$=1800V, f=1.5 kHz, and $V_{AC}$ is a sin wave).

By performing beta-printing of halftone of 25% on general paper having a size of A4 in indoor environments having a temperature 23° C. and a humidity of 50%, a durability experiment on 10 k (10000) sheets of monochrome is performed.

In the comparative examples of Nos. 17, 20, and 21, the rotation direction of the cleaning member is set to the rotation direction (backward direction) of the charging roller and the rotation direction of the cleaning member is set to the rotation direction (forward direction) of the charging roller.

A case where an image having good image quality is obtained with the naked eye and the optical record device 104 is not contaminated is denoted by o, and a case where the optical record device 104 is contaminated is denoted by x.

The experimental examples of Nos. 1 to 4, 6 to 9, 11, 12, 14, and 19 were denoted by o, because the optical record device is not contaminated and the image having good image quality is obtained although 10 k sheets of print is performed. In contrast, the comparative examples of Nos. 5, 10, 13, 15 to 18, and 20 to 23 were denoted by x, because the optical record device is contaminated and the image quality deteriorates before 1000 sheets of print is performed.

By this experiment, by the image forming apparatus 101 for charging the photosensitive body 102 using the charging roller 103*a* with the non-contact manner, it is verified that at least one of the above-described effects of the present invention is obtained.

The fifth embodiment of the present invention is applicable to an image forming apparatus such as an electrophotography, an electrostatic copier, a printer, and a facsimile. In the image forming apparatus for charging the image carrier using the charging roller with the non-contact manner, the charging roller, the optical record device, and the development roller device are sequentially arranged toward the downstream side in the rotation direction of the image carrier and the charging roller is cleaned by the cleaning member which is closely in contact with the charging roller.

What is claimed is:

1. A charging roller, configured to face an image carrier at a predetermined charging gap and charge the image carrier in a non-contact state, comprising:

a conductive shaft, provided with a pair of annular concave portions formed on an outer circumferential surface at both ends thereof;

a conductive layer, formed on the outer circumference surface at a center portion of the conductive shaft defined between the pair of concave portions; and an insulating layer, formed on the outer circumferential surface at outer portions of the conductive shaft from the pair of annular concave portions, wherein a depth of the concave portions is larger than a thickness of the conductive layer.

2. The charging roller according to claim 1, wherein a depth of the concave portions is larger than a thickness of the insulating layer.

3. The charging roller according to claim 1, wherein a depth of the concave portions is larger than a sum of a thickness of the conductive layer and a thickness of the insulating layer.

4. The charging roller according to claim 1, wherein edges of the conductive shaft defining the concave portions are chamfered.

5. The charging roller according to claim 1, wherein the insulating layer includes an elastic insulating member.

6. The charging roller according to claim 1, wherein the insulating layer includes a rubber member.

7. The charging roller according to claim 1, wherein the insulating layer includes a thermal shrinkage tube.

8. The charging roller according to claim 1, wherein the conductive layer is formed on outer circumferential surfaces of the concave portions.

9. The charging roller according to claim 1, wherein the conductive layer is formed on outer circumferential surface of the insulating layer.

* * * * *